US009707779B2

(12) United States Patent
Yoshida et al.

(10) Patent No.: US 9,707,779 B2
(45) **Date of Patent: *Jul. 18, 2017**

(54) PRINTING DEVICE CONTROLLING CONVEYANCE AMOUNT OF SHEET

(71) Applicant: BROTHER KOGYO KABUSHIKI KAISHA, Nagoya-shi, Aichi-ken (JP)

(72) Inventors: Yasunari Yoshida, Aichi-ken (JP); Tsuyoshi Ito, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/131,271

(22) Filed: Apr. 18, 2016

(65) Prior Publication Data

US 2016/0229204 A1 Aug. 11, 2016

Related U.S. Application Data

(62) Division of application No. 14/333,899, filed on Jul. 17, 2014, now Pat. No. 9,359,160.

(30) Foreign Application Priority Data

Jul. 31, 2013 (JP) ..... 2013-160005

(51) Int. Cl.
*B41J 29/38* (2006.01)
*B41J 13/00* (2006.01)
(Continued)

(52) U.S. Cl.
CPC ..... *B41J 13/0009* (2013.01); *B41J 11/005* (2013.01); *B41J 11/008* (2013.01);
(Continued)

(58) Field of Classification Search
USPC ..... 347/12, 13, 16
See application file for complete search history.

(56) References Cited

U.S. PATENT DOCUMENTS 6,511,144 B2 1/2003 Otsuki
6,896,432 B2 5/2005 Ohyama
(Continued)

FOREIGN PATENT DOCUMENTS

JP 2001-315314 A 11/2001
JP 2005-059318 A 3/2005
(Continued)

OTHER PUBLICATIONS

Related U.S. Appl. No. 14/722,415, filed May 27, 2015.
U.S. Office Action (Notice of Allowance) issued in related U.S. Appl. No. 14/722,415 mailed Mar. 15, 2016.

*Primary Examiner* — Lam Nguyen
(74) *Attorney, Agent, or Firm* — Merchant & Gould P.C.

(57) ABSTRACT

A printing device executes processes (a)-(c). In the process (a), first and second rollers convey a sheet a first amount, and a print head executes a printing operation while the sheet is in a state where the sheet is supported by the first and second rollers and a supporting unit disposed between the first and second rollers. In the process (b), the second roller conveys the sheet a second amount that is no larger than the first amount, and the print head executes a printing operation while the sheet is in a state where the sheet is supported by the supporting unit and the second roller. In the process (c), the second roller conveys the sheet a third amount that is larger than the first amount, and the print head executes a printing operation while the sheet is in a state where the sheet is supported by the second roller.

5 Claims, 11 Drawing Sheets

(51) Int. Cl.

| | |
|---|---|
| ***B65H 7/20*** | (2006.01) |
| ***B41J 11/00*** | (2006.01) |
| ***B41J 11/08*** | (2006.01) |
| ***B41J 11/04*** | (2006.01) |
| ***B65H 5/06*** | (2006.01) |

(52) U.S. Cl.

CPC ..... *B41J 11/04* (2013.01); *B41J 11/08* (2013.01); *B65H 5/062* (2013.01); *B65H 7/20* (2013.01)

(56) References Cited

U.S. PATENT DOCUMENTS

| | | | |
|---|---|---|---|
| 2002/0130942 | A1 | 9/2002 | Walker |
| 2004/0183879 | A1 | 9/2004 | Nakazawa |
| 2005/0030333 | A1 | 2/2005 | Takahashi et al. |
| 2007/0057996 | A1 | 3/2007 | Yazawa et al. |

FOREIGN PATENT DOCUMENTS

| | | | |
|---|---|---|---|
| JP | 2005-271231 | A | 10/2005 |
| JP | 2006-044060 | A | 2/2006 |
| JP | 2006-103278 | A | 4/2006 |
| JP | 2010-179656 | A | 8/2010 |

PRINTING DEVICE CONTROLLING CONVEYANCE AMOUNT OF SHEET

CROSS REFERENCE TO RELATED APPLICATION

This application is a divisional application of U.S. patent application Ser. No. 14/333,899, filed Jul. 17, 2014, and further claims priority from Japanese Patent Application No. 2013-160005 filed Jul. 31, 2013. The entire contents of both of these applications is incorporated herein by reference.

TECHNICAL FIELD

The present invention relates to a printing device.

BACKGROUND

A printer that prints images by forming dots on paper in a colorant such as ink is well known in the art. One example of such a printer employs a pair of rollers disposed on the upstream side of a print head and a pair of rollers disposed on the downstream side of the print head to hold the paper while conveying the paper from the upstream side toward the downstream side. When this type of printer executes a printing operation on a sheet of paper, the sheet is held and conveyed by both pairs of rollers while its center portion in the conveying direction passes by the print head. However, only one of the two pairs of rollers holds and conveys the sheet when the upstream edge or downstream edge of the sheet passes by the print head, while the other pair of rollers does not hold the sheet.

Japanese unexamined patent application publication No. 2005-271231 describes a technique for increasing the conveyance amount of the sheet from the preceding conveyance amount when the sheet transitions from a double-held state, in which roller pairs on both sides of the print head grip the sheet, to a single-held state, in which only one pair grips the sheet in order to reduce a decline in the precision for conveying the sheet during this transition.

SUMMARY

However, with the conventional technique, printing quality may deteriorate when printing in areas near the edges of the sheet, due to distortion in the shape of the sheet. That is, since an edge of the sheet is positioned between the two pairs of rollers when the printer is printing a region near the sheet's edge, only one of the two pairs of rollers is holding the sheet at this time. Under these circumstances, the edge of the sheet may move due to deformation (curvature) of the sheet. For example, the edge may move closer to or farther away from the print head. Movement in the edge of the sheet changes the gap between the print head and sheet, resulting in reduced print quality due to positional deviation in formed dots and ink smudges where the paper contacts the print head, for example.

In view of the foregoing, it is an object of the present invention to provide a technique for reducing deterioration in print quality occurring when printing the edges of a sheet.

In order to attain the above and other objects, the invention provides a printing device that may include a print head, a conveying mechanism, and a control device. The conveying mechanism may be configured to convey a sheet in a conveying direction. The sheet has one surface and another surface opposite to the one surface. The conveying mechanism may include a first roller, a second roller, and a supporting unit. The first roller may be disposed upstream of the print head in the conveying direction. The second roller may be disposed downstream of the print head in the conveying direction. The supporting unit may be disposed between the first roller and the second roller and closer to the first roller than the second roller and configured to support the sheet. The supporting unit may include a first contacting unit and a second contacting unit. The first contacting unit may be configured to contact the one surface of the sheet. The second contacting unit may be configured to contact the another surface of the sheet. The control device may be configured to control the print head and the conveying mechanism to: execute a process (a); execute a process (b) after the process (a) is executed at least one time; and execute a process (c) after the process (b) is executed at least one time. In the process (a), at least one of the first roller and the second roller may be driven to convey the sheet a first conveyance amount, and the print head may be driven to execute a printing operation while the sheet is in a first state where the sheet is supported by the first roller, the supporting unit, and the second roller. In the process (b), at least the second roller may be driven to convey the sheet a second conveyance amount that is less than or equal to the first conveyance amount, and the print head may be driven to execute a printing operation while the sheet is in a second state where the sheet is not supported by the first roller and where the sheet is supported by the supporting unit and the second roller. In the process (c), at least the second roller may be driven to convey the sheet a third conveyance amount that is larger than the first conveyance amount, and the print head may be driven to execute a printing operation while the sheet is in a third state where the sheet is not supported by either of the first roller or the supporting unit and where the sheet is supported by the second roller.

According to another aspect, the present invention provides a printing device that may include a print head, a conveying mechanism, and a control device. The print head may have a plurality of nozzles arranged in a conveying direction. The plurality of nozzles may include a most-downstream nozzle that is disposed at a most downstream position in the conveying direction among the plurality of nozzles. The conveying mechanism may be configured to convey a sheet in the conveying direction. The sheet has one surface and another surface opposite to the one surface. The conveying mechanism may include a first roller and a second roller. The first roller may be disposed upstream of the print head in the conveying direction. The second roller may be disposed downstream of the print head in the conveying direction. The control device may be configured to control the print head and the conveying mechanism to: execute a first process a plurality of times; execute a second process at least one time after the first process is executed the plurality of times; and execute a third process a plurality of times after the second process is executed. The first process may be a process in which: at least the first roller may be driven to convey the sheet a first conveyance distance; and the print head may be driven to execute a printing operation while the sheet is in a state where the sheet is supported by the first roller and where the sheet is not supported by the second roller. The second process may be a process in which: at least the first roller may be driven to convey the sheet a second conveyance distance that is larger than the first conveyance distance; and the print head may be driven to execute a printing operation while the sheet is in a state where the sheet is supported by the first roller and the second roller. The third process may be a process in which: at least one of the first roller and the second roller may be driven to convey the sheet a third conveyance distance that is less than the second conveyance distance; and the print head may be driven to execute a printing operation while the sheet is in a state where the sheet is supported by the first roller and the second roller. The second conveyance distance may be larger than a distance between the most-downstream nozzle and the second roller in the conveying direction.

According to another aspect, the present invention provides a non-transitory computer readable storage medium storing a set of program instructions executed by a computer. The computer may be configured to control a printing execution unit including a print head and a conveying mechanism configured to convey a sheet in a conveying direction. The sheet has one surface and another surface opposite to the one surface. The conveying mechanism may include a first roller, a second roller, and a supporting unit. The first roller may be disposed upstream of the print head in the conveying direction. The second roller may be disposed downstream of the print head in the conveying direction. The supporting unit may be disposed between the first roller and the second roller and closer to the first roller than the second roller and configured to support the sheet. The supporting unit may include a first contacting unit configured to contact the one surface of the sheet and a second contacting unit configured to contact the another surface of the sheet. The program instructions, when executed by the computer, may cause the printing execution unit to perform: execute a process (a); execute a process (b) after the process (a) is executed at least one time; and execute a process (c) after the process (b) is executed at least one time. In the process (a), at least one of the first roller and the second roller may be driven to convey the sheet a first conveyance amount, and the print head may be driven to execute a printing operation while the sheet is in a first state where the sheet is supported by the first roller, the supporting unit, and the second roller. In the process (b), at least the second roller may be driven to convey the sheet a second conveyance amount that is less than or equal to the first conveyance amount, and the print head may be driven to execute a printing operation while the sheet is in a second state where the sheet is not supported by the first roller and where the sheet is supported by the supporting unit and the second roller. In the process (c), at least the second roller may be driven to convey the sheet a third conveyance amount that is larger than the first conveyance amount, and the print head may be driven to execute a printing operation while the sheet is in a third state where the sheet is not supported by either of the first roller or the supporting unit and where the sheet is supported by the second roller.

According to another aspect, the present invention provides a non-transitory computer readable storage medium storing a set of program instructions executed by a computer. The computer may be configured to control a printing execution unit including a print head and a conveying mechanism. The print head may have a plurality of nozzles arranged in a conveying direction. The plurality of nozzles may include a most-downstream nozzle that is disposed at a most downstream position in the conveying direction among the plurality of nozzles. The conveying mechanism may be configured to convey a sheet in the conveying direction. The sheet has one surface and another surface opposite to the one surface. The conveying mechanism may include a first roller and a second roller. The first roller may be disposed upstream of the print head in the conveying direction. The second roller may be disposed downstream of the print head in the conveying direction. The program instructions, when executed by the computer, may cause the printing execution unit to: execute a first process a plurality of times; execute a second process at least one time after the first process is executed the plurality of times; and execute a third process a plurality of times after the second process is executed. The first process may be a process in which: at least the first roller may be driven to convey the sheet a first conveyance distance; and the print head may be driven to execute a printing operation while the sheet is in a state where the sheet is supported by the first roller and where the sheet is not supported by the second roller. The second process may be a process in which: at least the first roller may be driven to convey the sheet a second conveyance distance that is larger than the first conveyance distance; and the print head may be driven to execute a printing operation while the sheet is in a state where the sheet is supported by the first roller and the second roller. The third process may be a process in which: at least one of the first roller and the second roller may be driven to convey the sheet a third conveyance distance that is less than the second conveyance distance; and the print head may be driven to execute a printing operation while the sheet is in a state where the sheet is supported by the first roller and the second roller. The second conveyance distance may be larger than a distance between the most-downstream nozzle and the second roller in the conveying direction.

BRIEF DESCRIPTION OF THE DRAWINGS

The particular features and advantages of the invention as well as other objects will become apparent from the following description taken in connection with the accompanying drawings, in which.

DETAILED DESCRIPTION

A. First Embodiment

A-1. Structure of a Printing Device

Figure 1:
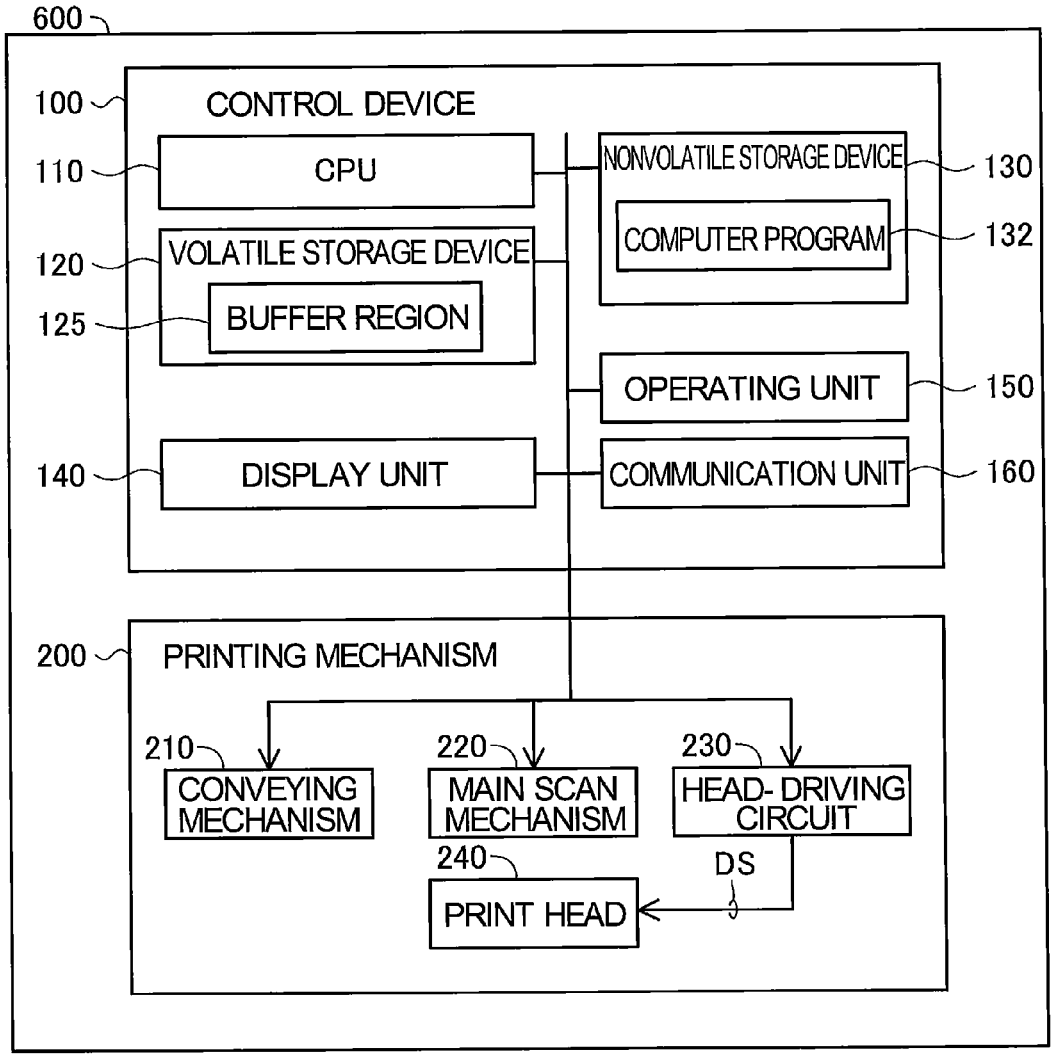
FIG. 1 is a block diagram showing the structure of a printing device according to a first embodiment of the present invention.

Next, first to fourth embodiments of the present invention will be described while referring to FIGS. 1 to 10. FIG. 1 is a block diagram showing the structure of a printer 600 according to the first embodiment. The printer 600 is an inkjet printer that prints images on sheets of paper by forming dots on the paper with ink. The printer 600 includes a control device 100 for controlling all operations of the printer 600, and a printing mechanism 200 for executing printing operations.

The control device 100 includes a CPU 110; a volatile storage device 120, such as DRAM; a nonvolatile storage device 130, such as flash memory or a hard disk drive; a display unit 140, such as a liquid crystal display; an operating unit 150, such as a touchscreen superimposed on a liquid crystal display panel and various buttons; and a communication unit 160 having a communication interface for communicating with external devices, such as a personal computer (not shown).

The volatile storage device 120 is provided with a buffer region 125 for temporarily storing various intermediate data generated when the CPU 110 performs processes. The nonvolatile storage device 130 stores a computer program 132 for controlling the printer 600.

The computer program 132 is pre-stored in the nonvolatile storage device 130 prior to shipping the printer 600. The computer program 132 may be supplied to the user on a DVD-ROM or other storage medium, or may be made available for download from a server. By executing the computer program 132, CPU 110 implements a control process of the printer 600 described later.

The printing mechanism 200 executes printing operations by ejecting ink in the colors cyan (C), magenta (M), yellow (Y), and black (K) under control of the CPU 110 in the control device 100. The printing mechanism 200 includes a conveying mechanism 210, a main scan mechanism 220, a head-driving circuit 230, and a print head 240. The conveying mechanism 210 is provided with a conveying motor (not shown) that produces a drive force for conveying sheets of paper in a conveying direction. The main scan mechanism 220 is provided with a main scan motor (not shown) that produces a drive force for reciprocating the print head 240 in the main scanning direction (hereinafter also called a "main scan"). The head-driving circuit 230 provides a drive signal DS to the print head 240 for driving the print head 240 while the main scan mechanism 220 is moving the print head 240 in a main scan. The print head 240 forms dots on a sheet of paper conveyed by the conveying mechanism 210 by ejecting ink according to the drive signal DS.

Figure 2:
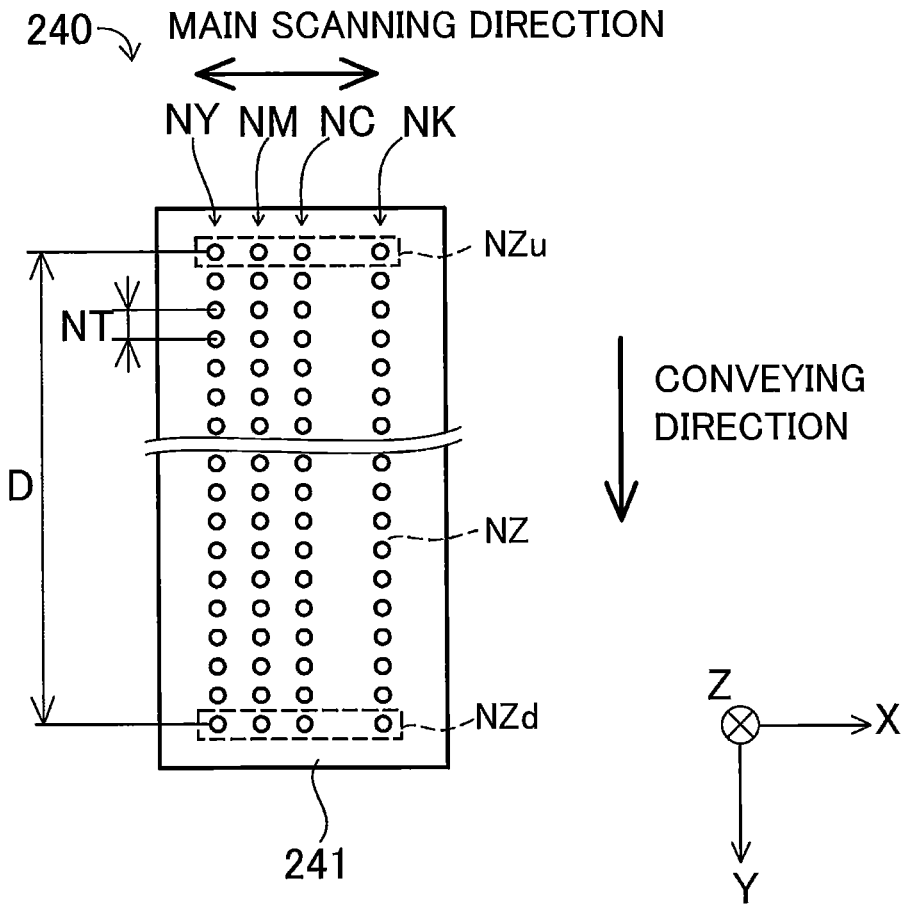
FIG. 2 shows the structure of a print head of the printing device.

FIG. 2 shows the general structure of the print head 240. As shown in FIG. 2, the print head 240 has a nozzle-forming surface 241 constituting the −Z side thereof. Nozzle rows NC, NM, NY, and NK for ejecting ink droplets in the respective colors C, M, Y, and K are formed in the nozzle-forming surface 241 of the print head 240. Each row of nozzles includes a plurality of nozzles NZ. The nozzles NZ in each nozzle row are arranged at a prescribed nozzle pitch NT in the conveying direction. In FIG. 2 and subsequent drawings, the +Y direction denotes the conveying direction (sub scanning direction), and the X direction (+X and −X directions) denotes the main scanning direction that is substantially perpendicular to the conveying direction (+Y direction). The nozzle NZ in each nozzle row on the downstream end of the conveying direction (i.e., the +Y end in FIG. 2) will be called a most-downstream nozzle NZd, while the nozzle NZ positioned on the upstream end of the conveying direction (i.e., the −Y end in FIG. 2) will be called a most-upstream nozzle NZu. The length of the nozzle rows from the most-upstream nozzle NZu to the most-downstream nozzle NZd in the conveying direction will be called the nozzle length D.

Figure 3A:
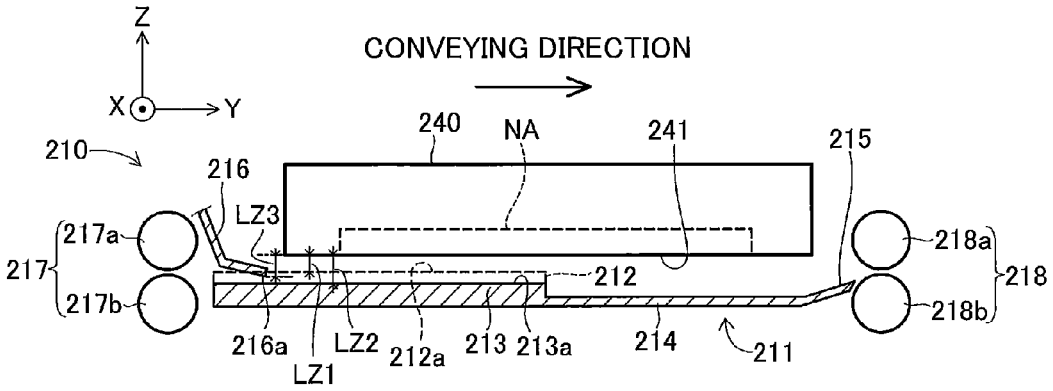
FIG. 3A is an explanatory diagram showing the structure of a conveying mechanism of the printing device.
Figure 3B:
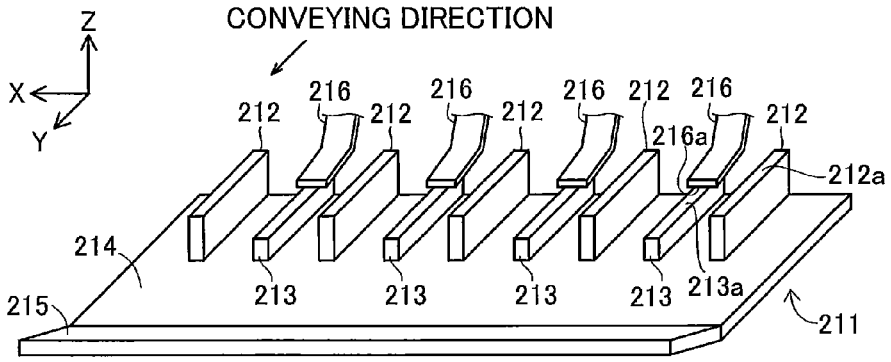
FIG. 3B is a perspective view of the supporting unit when a sheet is not interposed between first contacting parts and second contacting parts of the supporting unit.
Figure 3C:
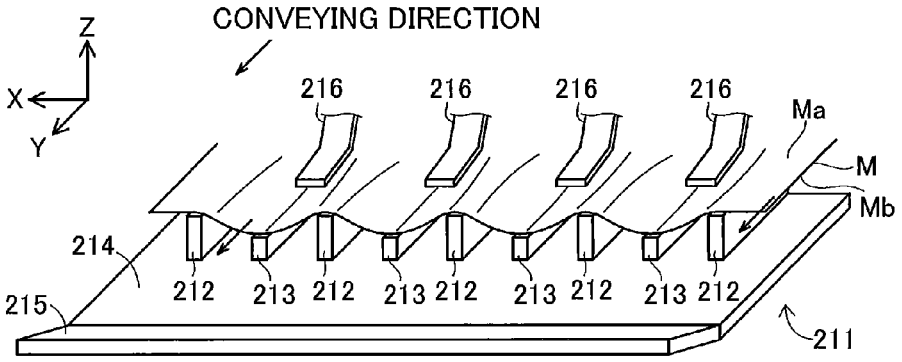
FIG. 3C is a perspective view of the supporting unit when a sheet is interposed between the first contacting parts and the second contacting parts.

FIGS. 3A-3C show the general structure of the conveying mechanism 210. As shown in FIG. 3A, the conveying mechanism 210 includes a sheet support 211, a pair of upstream rollers 217, a pair of downstream rollers 218, and a plurality of pressing members 216.

The upstream rollers 217 are disposed on the upstream side (−Y side) of the print head 240 in the conveying direction, while the downstream rollers 218 are positioned on the downstream side (on the +Y side) of the print head 240 in the conveying direction. The upstream rollers 217 and downstream rollers 218 hold and convey sheets of paper. The upstream rollers 217 include a drive roller 217*a*, and a follow roller 217*b*. The drive roller 217*a* is driven to rotate by a conveying motor (not shown). The follow roller 217*b* rotates along with the rotation of the drive roller 217*a*. Similarly, the downstream rollers 218 include a drive roller 218*a*, and a follow roller 218*b*. Note that plate members may be employed in place of the follow rollers, whereby sheets of paper are held between the drive rollers and corresponding plate members.

The sheet support 211 is disposed at a position between the upstream rollers 217 and the downstream rollers 218 and confronts the nozzle-forming surface 241 of the print head 240. The pressing members 216 are arranged between the upstream rollers 217 and the print head 240.

FIGS. 3B and 3C are perspective views of the sheet support 211 and pressing members 216. FIG. 3B shows the components when a sheet M is not interposed between the pressing members 216 and sheet support 211, and FIG. 3C shows the components when the sheet M is interposed between the pressing members 216 and sheet support 211. The sheet support 211 includes a plurality of high support members 212, a plurality of low support members 213, a flat plate 214, and a sloped part 215.

The flat plate 214 is a plate-shaped member that is arranged parallel to the main scanning direction (X direction) and the conveying direction (+Y direction). The edge of the flat plate 214 on the −Y side is positioned near the upstream rollers 217 and extends farther in the −Y direction than the −Y side of the print head 240. The sloped part 215 is a plate-shaped member positioned on the +Y side of the flat plate 214 that slopes upward in the +Y direction. The +Y edge of the sloped part 215 is positioned near the downstream rollers 218 and extends farther in the +Y direction than the +Y side of the print head 240. The dimension of the flat plate 214 in the X direction is longer than the dimension of a sheet M in the X direction by a prescribed amount. Accordingly, when the printer 600 executes a borderless printing operation for printing both edges of the sheet M in the X direction (main scanning direction) so that no borders remain on these edges, the flat plate 214 can receive ink ejected beyond the edges of the sheet M in the X direction.

The high support members 212 and low support members 213 are alternately arranged on the flat plate 214 along the X direction. Thus, each low support member 213 is disposed between two neighboring high support members 212. The high support members 212 are ribs that extend in the Y direction. The −Y end of each high support member 212 is flush with the −Y edge of the flat plate 214, and the +Y end of each high support member 212 is disposed in the center region of the flat plate 214 relative to the Y direction. The +Y end of each high support member 212 may be said to be positioned in the center region of a nozzle area NA relative to the Y direction, where the nozzle area NA is the region in which the plurality of nozzles NZ are formed in the print head 240. The end positions of the low support members 213 in the Y direction are identical to those end positions of the high support members 212.

The pressing members 216 are disposed on the +Z side of the corresponding low support members 213 and at the same positions in the X direction as the low support members 213. In other words, each pressing member 216 is positioned between two neighboring high support members 212 in the X direction. The pressing members 216 are plate-shaped members that slope toward the low support members 213 along the +Y direction. The +Y ends of the pressing members 216 are positioned between the upstream rollers 217 and the −Y side of the print head 240.

The pluralities of high support members 212, low support members 213, and pressing members 216 are positioned closer to the upstream rollers 217 than the downstream rollers 218 and, hence, may be considered to be provided on the upstream rollers 217 side of the conveying mechanism 210 with respect to the upstream rollers 217 and downstream rollers 218.

As shown in FIG. 3C, a sheet M of paper conveyed by the conveying mechanism 210 has a printing surface Ma on which the print head 240 ejects ink droplets, and a back surface Mb on the opposite side of the printing surface Ma. As the sheet M is conveyed, the high support members 212 and low support members 213 support the sheet M on the back surface Mb side and the pressing members 216 support the sheet M on the printing surface Ma side. The portion of each high support member 212 supporting the sheet M (i.e., a surface 212*a* on the +Z side of each high support member 212; see FIG. 3A) is positioned farther in the +Z direction than the portion of each low support member 213 supporting the sheet M (i.e., a surface 213*a* on the +Z side of each low support member 213; see FIG. 3A). Therefore, the distance LZ1 between the surfaces 212*a* of the high support members 212 and the nozzle-forming surface 241 of the print head 240 is shorter than the distance LZ2 between the surfaces 213*a* of the low support members 213 and the nozzle-forming surface 241.

Further, the surfaces 212*a* of the high support members 212 are positioned farther in the +Z direction than the portions of the pressing members 216 that support the sheet M (i.e., bottom edges 216*a* on the −Z side of the pressing members 216 at the +Y edge of the same; see FIG. 3A). Therefore, the distance LZ1 between the surfaces 212*a* of the high support members 212 and the nozzle-forming surface 241 of the print head 240 is shorter than a distance LZ3 between the bottom edges 216*a* of the pressing members 216 and the nozzle-forming surface 241.

Thus, the sheet M is supported by the high support members 212, low support members 213, and pressing members 216 in a corrugated state, with undulations progressing in the X direction (see FIG. 3C). While remaining bent in this corrugated state, the sheet M is conveyed in the conveying direction (+Y direction). When bent into this corrugated shape, the sheet M has greater rigidity and is resistant to deformation along the Y direction. Accordingly, this arrangement restrains the sheet M from warping or curling along the Y direction so that the sheet M does not float off the sheet support 211 toward the print head 240 or sag toward the sheet support 211. Dot forming positions may deviate when the sheet M rises and falls, leading to a drop in the quality of the printed image. Further, the sheet M may contact the print head 240 when rising, producing ink smudges on the sheet M.

When the fibers of the paper are aligned in the X direction, the paper is more likely to warp during printing than when the fibers run in the Y direction. Consequently, there is a greater necessity to convey sheets whose fibers are aligned in the X direction in a corrugated state.

In the above description, the high support members 212 are examples of the first contacting members and the pressing members 216 are examples of the second contacting members. Further, the drive roller 217*a* of the upstream rollers 217 is an example of the first roller, while the drive roller 218*a* of the downstream rollers 218 is an example of the second roller.

A-2. Operations of the Printing Device

The printer 600 executes a printing process based on a print command from the user. More specifically, the CPU 110 of the printer 600 acquires image data of a prescribed format from an external device based on user commands. The format of the image data may be data compressed in the JPEG format or data described in a page description language, for example. The CPU 110 generates dot data from this acquired image data by executing various well-known processes on the data including a rasterization process, a color conversion process, and a halftone process.

In the rasterization process, the CPU 110 converts the image data acquired above to RGB image data including gradation values for each of three color components: red (R), green (G), and blue (B), for example. In the color conversion process, the CPU 110 converts the RGB image data to CMYK image data including gradation values for components corresponding to the colors of ink used in the printer 600 (the four colors C, M, Y, and K in this example). In the halftone process, the CPU 110 converts the CMYK image data to dot data representing the formation state of a dot for each pixel in the image being printed. The dot formation state of a pixel may be expressed in one of two levels "dot" or "no dot" or in one of four levels "large dot," "medium dot," "small dot," or "no dot," for example.

Using this dot data, the CPU 110 further generates a print job that includes print data obtained by rearranging the order in which dot data is used in the plurality of main scans described later, and control data for controlling the printer 600. The control data includes data specifying which of the nozzles NZ are used in each of the main scans, and data specifying a conveyance amount for each of the sub scans described later, for example. Based on the print job generated above, the CPU 110 controls the printing mechanism 200 to print an image represented by the print data on a sheet M.

The CPU 110 executes the printing process for printing an image on sheets M by alternately repeating a sub scan and main scan. In one sub scan, the CPU 110 conveys the sheet M exactly a prescribed conveyance amount. In one main scan, the CPU 110 drives the main scan mechanism 220 (see FIG. 1) to move the print head 240 (see FIGS. 1 and 2) once in the main scanning direction (X direction) while the sheet M is stationary. While the print head 240 is moving during a single main scan, the CPU 110 controls the head-driving circuit 230 (see FIG. 1) to supply a drive signal DS to the print head 240 for ejecting ink from nozzles NZ in the print head 240.

Figure 4:
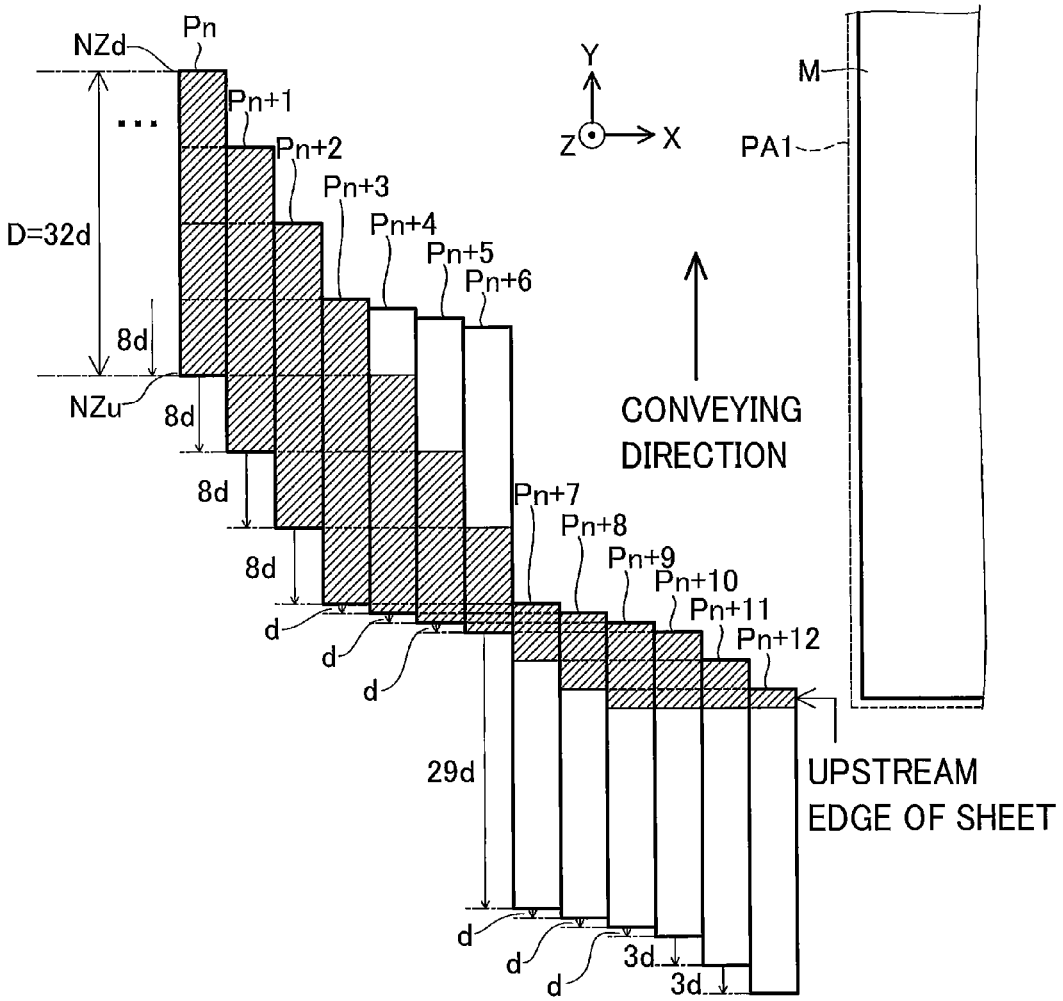
FIG. 4 is an explanatory diagram showing a position of the print head for each main scan in the first embodiment.

FIG. 4 shows the position of the print head 240 (hereinafter called the "head position") during each of a plurality of main scans for printing an area near the edge of a sheet M on the upstream side (−Y side) in the conveying direction (hereinafter called the "upstream edge"). The head position is the position of the print head 240 in the Y direction relative to the sheet M depicted on the right side of FIG. 4. The length in the Y direction of the box depicting each head position indicates the length in the Y direction of the nozzle area NA for the print head 240, i.e., the nozzle length D. The head position Pk corresponds to the $k^{th}$ main scan, where k is a natural number. FIG. 4 shows thirteen head positions Pn−Pn+12 corresponding to thirteen main scans from the $n^{th}$ main scan to the $(n+12)^{th}$ main scan, where n is a specific value.

The first sub scan in the first embodiment is a scan for conveying the sheet M to its initial position, i.e., the operation for conveying the sheet M to the position at which the first main scan is executed. The $k^{th}$ sub scan for $k \geq 2$ is the sub scan executed between the $(k-1)^{th}$ main scan and the $k^{th}$ main scan. FIG. 4 shows various conveyance amounts used for the thirteen sub scans (conveyance amounts 8d, d, 29d, and 3d in this example). As illustrated in FIG. 4, the head position moves in the direction opposite the conveying direction relative to the sheet M (the −Y direction) when each sub scan is executed.

In the printing process of the first embodiment, the CPU 110 executes a four-pass print for printing one partial region on the sheet M using four main scans. One partial region is a region whose width in the conveying direction is the nozzle length D, for example. The four-pass print in the first embodiment is a high-resolution print for forming raster lines along the main scanning direction at intervals in the conveying direction smaller than the nozzle pitch NT (see FIG. 2; one-fourth of the nozzle pitch NT, for example). Alternatively, a four-pass print may be implemented according to a shingling technique for distributing the dots formed in a single raster line among four main scans.

A printing area PA1 is indicated on the right side of FIG. 4 with a dashed line. The printing area PA1 is the area that is printed during the printing process for the sheet M. In the printing process of the first embodiment, the CPU 110 executes a borderless print. In a borderless print, the printer 600 can print all the way up to all four edges of the sheet M, without leaving any white space. Accordingly, the printing area PA1 is set slightly larger than the size of the sheet M so that the four edges of the printing area PA1 are positioned slightly outside the corresponding edges of the sheet M (2.5 mm beyond the edges of the sheet M, for example).

Shaded areas in the boxes depicting head positions in FIG. 4 denote the positions of nozzles NZ formed in the print head 240 that are used for printing in each pass (hereinafter called the "active nozzles").

Figure 5:
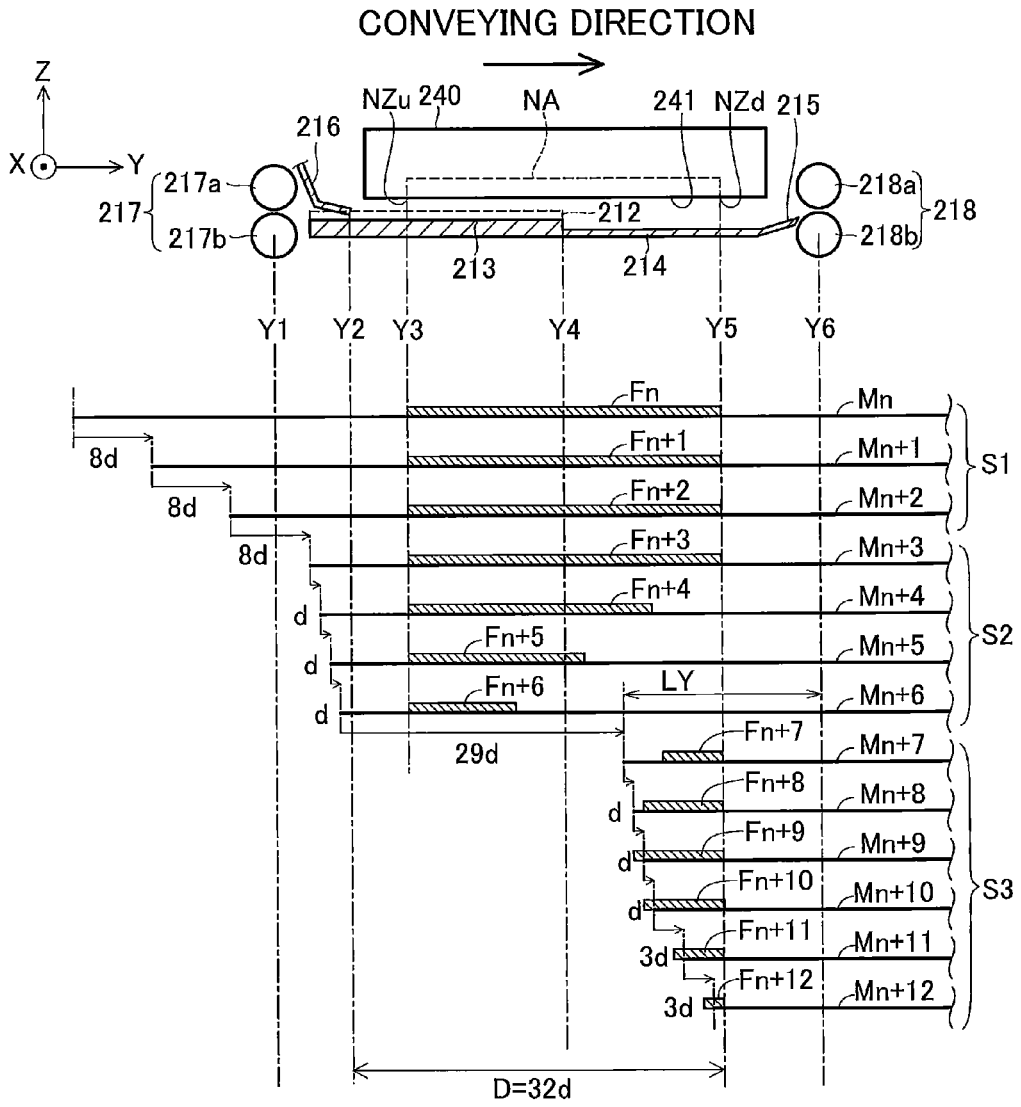
FIG. 5 is an explanatory diagram showing a position of a sheet for each main scan in the first embodiment.

FIG. 5 shows the position of the sheet M relative to the print head 240 for each main scan used to print the area near the upstream edge of the sheet M. As shown in FIG. 5, the sheet M moves in the conveying direction (+Y direction) relative to the print head 240 each time a sub scan is executed. The sheet position Mk indicates the position of the sheet M when the $k^{th}$ main scan is executed. FIG. 5 shows thirteen sheet positions Mn−Mn+12 corresponding to the $n^{th}$ through $(n+12)^{th}$ main scans. Shaded regions Fn−Fn+12 on the sheet M for sheet positions Mn through Mn+12 denote areas of the sheet M that are printed in the corresponding main scan. The printing regions Fn−Fn+12 in FIG. 5 correspond to the positions of the active nozzles depicted by shading in FIG. 4.

Positions Y1 and Y6 in FIG. 5 denote the respective positions on the sheet M in the Y direction at which the upstream rollers 217 and downstream rollers 218 hold the sheet M. Position Y2 is the position in the Y direction at which the high support members 212 and pressing members 216 hold the sheet M. Positions Y3 and Y5 are the respective positions in the Y direction of the most-upstream nozzle NZu and most-downstream nozzle NZd in the print head 240. In one main scan, the printer 600 can print a maximum range covering the region between position Y3 and position Y5. A position Y4 marks the ends of the high support members 212 and low support members 213 on the +Y side.

As a sheet M is conveyed in the conveying direction, the CPU 110 sequentially prints areas on the sheet M, beginning from an area near the edge on the downstream side (+Y side) of the sheet M in the conveying direction (hereinafter simply called the "downstream edge"). After printing the area near the downstream edge of the sheet M, the CPU 110 prints the center region of the sheet M relative to the conveying direction.

After printing the center area of the sheet M in the conveying direction, the CPU 110 executes a printing operation in an area near the upstream edge of the sheet M shown in FIGS. 4 and 5. As shown in FIGS. 4 and 5, the CPU 110 alternately executes each of three sub scans from an $n^{th}$ sub scan to an $(n+2)^{th}$ sub scan and each of three main scans from an $n^{th}$ main scan to an $(n+2)^{th}$ main scan.

As shown in FIGS. 4 and 5, the conveyance amount in each of the $n^{th}$ through $(n+2)^{th}$ sub scans is 8d. Here, the length d is one thirty-second the nozzle length D (D=32d). Therefore, the length 8d is one-fourth the nozzle length D and is a uniform conveyance amount HM for a four-pass print. The uniform conveyance amount HM is the maximum conveyance amount possible when executing multi-pass printing, such as four-pass printing, with uniform conveyance amounts. In other words, the uniform conveyance amount HM is the conveyance amount selected when executing multi-pass printing at uniform conveyance amounts using all nozzles within the nozzle length D.

Since all nozzles NZ formed in the print head 240 across the nozzle length D are used in the $n^{th}$ through $(n+2)^{th}$ main scans, all nozzles NZ are active nozzles.

When executing the $n^{th}$ through $(n+2)^{th}$ main scans, the upstream edge of the sheet M is on the −Y side of the holding position Y1 at which the upstream rollers 217 hold the sheet M. Therefore, the $n^{th}$ through $(n+2)^{th}$ main scans are executed while the sheet M is held by the upstream rollers 217, supported by the pluralities of high support members 212 and pressing members 216, and held by the downstream rollers 218. This arrangement will be called a first state S1 (see FIG. 5). Thus, the CPU 110 drives both the upstream drive roller 217*a* and the downstream drive roller 218*a* to execute the $n^{th}$ through $(n+2)^{th}$ sub scans.

The CPU 110 executes the printing operation on the center region of the sheet M described above by repeatedly executing the same sub scan as the $n^{th}$ sub scan described above and the same main scan as the $n^{th}$ main scan. In other words, the CPU 110 executes a printing process for the center region of the sheet M relative to its conveying direction using four-pass printing for repeatedly executing a plurality of sub scans of equal conveyance amounts alternated with a plurality of main scans using all nozzles along the nozzle length D.

After completing the $(n+2)^{th}$ main scan, the CPU 110 executes the $(n+3)^{th}$ sub scan, followed by the $(n+3)^{th}$ main scan. The conveyance amount in the $(n+3)^{th}$ sub scan is 8d, which is the same as the conveyance amount in the $(n+2)^{th}$ sub scan. After executing the $(n+3)^{th}$ sub scan, the upstream edge of the sheet M has moved from the −Y side of the holding position Y1 to a point between positions Y1 and Y2, as shown in FIG. 5. Here, the downstream drive roller 218*a* is driven to convey the sheet M since the upstream rollers 217 cannot convey the sheet M when the upstream edge of the sheet M moves to the +Y side of the holding position Y1. Consequently, the CPU 110 executes the $(n+3)^{th}$ main scan while the sheet M is not held by the upstream rollers 217, is supported by the pluralities of high support members 212 and pressing members 216, and is held by the downstream rollers 218. This arrangement is called a second state S2 (see FIG. 5).

When the CPU 110 executes the printing operation for the $(n+3)^{th}$ main scan, all nozzles NZ formed in the print head 240 are active nozzles (see FIGS. 4 and 5).

After completing the $(n+3)^{th}$ main scan, the CPU 110 alternately executes the three $(n+4)^{th}$ through $(n+6)^{th}$ sub scans with the three $(n+4)^{th}$ through $(n+6)^{th}$ main scans (see FIGS. 4 and 5). A smaller conveyance amount d is used for each of the $(n+4)^{th}$ through $(n+6)^{th}$ sub scans. The conveyance amount d is one-eighth the conveyance amount 8d used in the $(n+3)^{th}$ sub scan.

As in the $(n+3)^{th}$ main scan, the CPU 110 executes the $(n+4)^{th}$ through $(n+6)^{th}$ main scan while the sheet M is in the second state S2 described above (see FIGS. 4 and 5).

The CPU 110 executes the printing operations in the $(n+4)^{th}$ through $(n+6)^{th}$ main scans using only a portion of the nozzles NZ formed in the print head 240. Specifically, the CPU 110 uses a set of the nozzles NZ belonging to each of the nozzle rows NC, NM, NY, and NK that includes the most-upstream nozzle NZu of the respective row, while not using a set of nozzles NZ that includes the most-downstream nozzle NZd. The number of active nozzles in the $(n+4)^{th}$ through $(n+6)^{th}$ main scans decreases in succeeding main scans. For example, a nozzle set covering a range equivalent to 25d from the upstream edge of the nozzle length D is used in the $(n+4)^{th}$ main scan, a nozzle set covering a range of 18d from the upstream edge is used in the $(n+5)^{th}$ main scan, and a nozzle set covering a range of 11d from the upstream edge is used in the $(n+6)^{th}$ main scan.

After the $(n+6)^{th}$ main scan, the CPU 110 executes the $(n+7)^{th}$ sub scan, followed by the $(n+7)^{th}$ main scan (see FIGS. 4 and 5). The conveyance amount used for the $(n+_7)^{th}$ sub scan is set to 29d, which is a conveyance amount 29 times larger than the conveyance amount d used in the $(n+4)^{th}$ through $(n+6)^{th}$ sub scans and is more than 3.5 times larger than the conveyance amount 8d used in the pluralities of sub scans culminating in the $(n+3)^{th}$ sub scan.

When the CPU 110 executes the $(n+7)^{th}$ sub scan, the upstream edge of the sheet M is moved from the −Y side of position Y2 to a point between positions Y2 and Y6, as shown in FIG. 5. Consequently, the CPU 110 executes the $(n+7)^{th}$ main scan while the sheet M is not held by the upstream rollers 217, not supported by the high support members 212 and pressing members 216, but held only by the downstream rollers 218. This arrangement is the third state S3 (see FIG. 5).

In the $(n+7)^{th}$ main scan, the CPU 110 executes the printing operation using a set of nozzles NZ that includes the most-downstream nozzle NZd in each nozzle row, while not using a set of nozzles NZ that includes the most-upstream nozzle NZu in each row (see FIGS. 4 and 5). Specifically, the set of nozzles used in the $(n+7)^{th}$ main scan covers a range equivalent to 6d from the downstream edge of the nozzle length D.

As is clear in FIGS. 4 and 5, the first nozzle set on the upstream side of the nozzle length D that is used in the $(n+6)^{th}$ main scan is not used in the $(n+7)^{th}$ main scan, and the second nozzle set on the downstream side of the nozzle length D that is used in the $(n+7)^{th}$ main scan is not used in the $(n+6)^{th}$ main scan.

After completing the $(n+7)^{th}$ main scan, the CPU 110 alternately executes each of three $(n+8)^{th}$ through $(n+10)^{th}$ sub scans with each of three $(n+8)^{th}$ through $(n+10)^{th}$ main scans (see FIGS. 4 and 5). The conveyance amount used in each of the $(n+8)^{th}$ through $(n+10)^{th}$ sub scans is the conveyance amount d, which is one twenty-ninth of the 29d used in the $(n+7)^{th}$ sub scan.

As in the $(n+7)^{th}$ main scan, the CPU 110 executes the $(n+8)^{th}$ through $(n+10)^{th}$ main scans while the sheet M is in the third state S3 described above (see FIGS. 4 and 5).

When the CPU 110 executes the printing operations in the $(n+8)^{th}$ through $(n+10)^{th}$ main scans, the active nozzles are set as a set of nozzles NZ that includes the most-downstream nozzle NZd for each nozzle row (see FIGS. 4 and 5). For example, a nozzle set covering a range of 8d from the downstream edge of the nozzle length D is used in the $(n+8)^{th}$ and $(n+10)^{th}$ main scans, while a nozzle set covering a range of 9d from the downstream edge is used in the $(n+9)^{th}$ main scan.

After completing the $(n+10)^{th}$ main scan, the CPU 110 alternately executes each of the two $(n+11)^{th}$ and $(n+12)^{th}$ sub scans with each of the two $(n+11)^{th}$ and $(n+12)^{th}$ main scans (see FIGS. 4 and 5). The conveyance amount used in each of the $(n+11)^{th}$ and $(n+12)^{th}$ sub scans is 3d, which is three times the conveyance amount d used in the $(n+10)^{th}$ sub scan.

As with the $(n+7)^{th}$ through $(n+10)^{th}$ main scans, the CPU 110 executes the $(n+11)^{th}$ and $(n+12)^{th}$ main scans while the sheet M is in the third state S3 described above (see FIGS. 4 and 5).

When the CPU 110 executes printing operations in the $(n+11)^{th}$ and $(n+12)^{th}$ main scans, the active nozzles are set to a set of nozzles NZ that includes the most-downstream nozzle NZd in each nozzle row (see FIGS. 4 and 5). For example, a nozzle set covering a range equivalent to 5d from the downstream edge of the nozzle length D is used in the $(n+11)^{th}$ main scan, while a nozzle set covering a range of 2d from the downstream edge is used in the $(n+12)^{th}$ main scan.

As indicated by printing regions Fn+9 through Fn+12 in FIG. 5, the CPU 110 prints in areas that include parts on the −Y side of the upstream edge of the sheet M during the $(n+9)^{th}$ through $(n+12)^{th}$ main scans. In this way, the printer 600 can perform borderless printing without leaving a white border on the upstream edge of the sheet M. Note that the region near the upstream edge of the sheet M in the printing regions Fn+9 through Fn+12 is printed on the +Y side of position Y4, where position Y4 indicates the downstream ends of the support members 212 and 213. Thus, ink ejected beyond the upstream edge of the sheet M in the −Y direction does not fall on the high support members 212 or low support members 213 that support and contact the sheets M, but falls on the flat plate 214. This configuration restrains ink from becoming deposited on the back surfaces Mb of sheets M on the opposite side of the printing surfaces Ma in subsequent printing operations.

After completing the $(n+12)^{th}$ main scan, the CPU 110 drives at least the downstream drive roller 218*a* to convey the printed sheet M onto a discharge tray (not shown), and subsequently ends the printing process.

The CPU 110 performs the following processes according to the first embodiment described above.

(a) The CPU 110 executes an operation to drive the drive rollers 217*a* and 218*a* in order to convey the sheet M a first conveyance amount (8d in the first embodiment) and a main scan operation while the sheet M is in the first state S1 at least one time each. More specifically, the CPU 110 executes at least three $n^{th}$ through $(n+2)^{th}$ sub scans at the conveyance amount 8d and three $n^{th}$ through $(n+2)^{th}$ main scans. The first conveyance amount is the uniform conveyance amount HM described above for the first embodiment.

(b) After completing the process in (a), the CPU 110 executes an operation to drive the downstream drive roller 218*a* in order to convey the sheet M a second conveyance amount (8d and d in the first embodiment) that is less than or equal to the first conveyance amount, and a main scan operation while the sheet M is in the second state S2 at least one time each. More specifically, the CPU 110 executes the $(n+3)^{th}$ sub scan at the conveyance amount 8d, the $(n+3)^{th}$ main scan, three $(n+4)^{th}$ through $(n+6)^{th}$ sub scans at the conveyance amount d, and three $(n+4)^{th}$ through $(n+6)^{th}$ main scans.

(c) After completing the process in (b), the CPU 110 executes an operation to drive the downstream drive roller 218*a* in order to convey the sheet M a third conveyance amount (29d in the first embodiment) that is larger than the first conveyance amount, and a main scan while the sheet M is in the third state S3. More specifically, the CPU 110 executes the $(n+7)^{th}$ sub scan at the conveyance amount 29d and the $(n+7)^{th}$ main scan.

The upstream edge of the sheet M is positioned between the upstream rollers 217 and downstream rollers 218 in the second state S2 (see FIG. 5). However, in the second state S2 the upstream edge of the sheet M is also positioned on the −Y side of the support position Y2 at which the high support members 212 and pressing members 216 support the sheet M. By supporting the sheet M, the high support members 212 and pressing members 216 restrain deformation of the sheet M, suppressing movement in the upstream edge of the sheet M (toward or away from the print head 240). Therefore, the structure of the first embodiment suppresses a decline in printing quality when printing on a sheet M that is in the second state S2, i.e., not held by the upstream rollers 217. Further, the high support members 212 and pressing members 216 transform the sheet M into a corrugated state (see FIG. 3C). Accordingly, the high support members 212 and pressing members 216 that support the sheet M maintain the sheet M in a corrugated state while the sheet M is in the second state S2, thereby effectively suppressing unintended deformation of the sheet M.

The sheet M subsequently transitions from the second state S2 to the third state S3. In the third state S3, the upstream edge of the sheet M is positioned on the +Y side of the support position Y2 at which the high support members 212 and pressing members 216 support the sheet M. Accordingly, the high support members 212 and pressing members 216 do not hold the sheet M. Since the high support members 212 and pressing members 216 cannot suppress deformation in the sheet M, the upstream edge of the sheet M can move, potentially causing deviation in dot forming positions that can degrade the quality of the printed image if the sheet M moves too close to or too far away from the nozzle-forming surface 241. Further, if the sheet M contacts the nozzle-forming surface 241, ink may be unintentionally deposited on the sheet M, forming smudges thereon. However, the sheet M is conveyed a relatively large third conveyance amount (specifically, the 29d) before shifting to the third state S3. Movement in the upstream edge of the sheet M is thought more likely to occur the greater the distance LY between the holding position Y6 at which the downstream rollers 218 hold the sheet M and the upstream edge of the sheet M (see FIG. 5). The distance LY is relatively short when the sheet M is in the third state S3 in the first embodiment after the sheet M has been conveyed the third conveyance amount. Accordingly, the configuration of the first embodiment minimizes movement in the upstream edge of the sheet M. For example, the configuration of the first embodiment can reduce the distance LY when the sheet M is in the third state S3 more than when four-pass printing is executed using a uniform conveyance amount HM (8d, for example) for all sub scans. Hence, the printer 600 of the first embodiment can minimize degradation in printing quality when printing on a sheet M in the third state S3, i.e., when the sheet M is not supported by the high support members 212 and pressing members 216. Further, by reducing the distance LY, the configuration of the first embodiment can reduce the area near the upstream edge of the sheet M that is printed while the sheet M is in the third state S3, thereby minimizing deterioration in print quality.

The printing process according to the first embodiment is particularly advantageous when the nozzle length D of the print head 240 is larger since the distance LY from the downstream rollers 218 to the upstream edge of the sheet M when the sheet M is in the third state S3 tends to increase for longer nozzle lengths D. Further, printing time while the sheet M is in the third state S3 is longer particularly in multi-pass printing, since the number of main scans executed while the sheet M is in the third state S3 is greater than when performing single-pass printing. Thus, the printing process of the first embodiment is advantageous because the sheet M is more likely to deform in the third state S3 when the printing time in the third state S3 is longer.

The CPU 110 further performs the following process (d) according to the first embodiment described above.

(d) After completing the process in (c), the CPU 110 executes multiple times an operation to drive the downstream drive roller 218*a* for conveying the sheet M a fourth conveyance amount (d and 3d in the first embodiment) smaller than the third conveyance amount (29d in the first embodiment), and a main scan while the sheet M is in the third state S3. Specifically, the CPU 110 executes three $(n+8)^{th}$ through $(n+10)^{th}$ sub scans at the conveyance amount d, three $(n+8)^{th}$ through $(n+10)^{th}$ main scans, two $(n+11)^{th}$ and $(n+12)^{th}$ sub scans at the conveyance amount 3d, and two $(n+11)^{th}$ and $(n+12)^{th}$ main scans. Thus, the printer 600 can execute printing operations suited to the region near the upstream edge of the sheet M.

In the $(n+6)^{th}$ main scan, which is the final main scan in the process of (b), the CPU 110 uses the most-upstream nozzle NZu in each nozzle row, but not the most-downstream nozzle NZd. Conversely, in the $(n+7)^{th}$ main scan, which is the initial main scan in the process of (c), the CPU 110 uses the most-downstream nozzle NZd in each nozzle row, but not the most-upstream nozzle NZu. Thus, the CPU 110 can execute suitable printing for the main scans performed before and after the $(n+6)^{th}$ sub scan at the relatively large third conveyance amount (specifically, 29d).

Further, in the $(n+6)^{th}$ main scan, which is the final main scan in the process of (b), the CPU 110 uses a first nozzle set, but not a second nozzle set positioned downstream of the first nozzle set in the conveying direction. Conversely, in the $(n+7)^{th}$ main scan, which is the initial main scan in the process of (c), the CPU 110 uses the second nozzle set, but not the first nozzle set. Thus, by executing printing operations using different nozzle sets in the main scans before and after the $(n+6)^{th}$ sub scan at the third conveyance amount, the CPU 110 can convey the sheet M the relatively large third conveyance amount in the $(n+6)^{th}$ sub scan.

B. Second Embodiment

Figure 6:
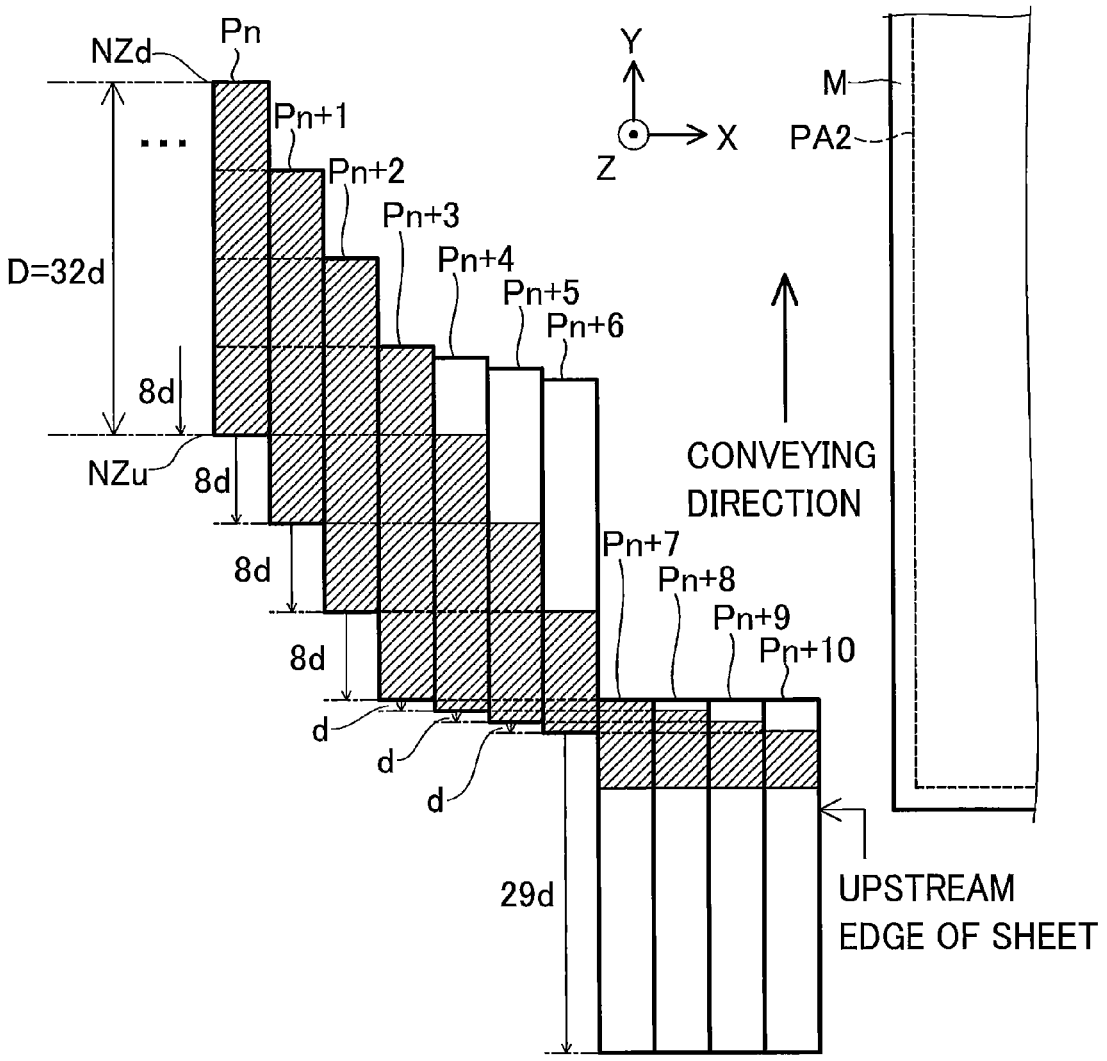
FIG. 6 is an explanatory diagram showing a position of the print head for each main scan in a second embodiment of the present invention.
Figure 7:
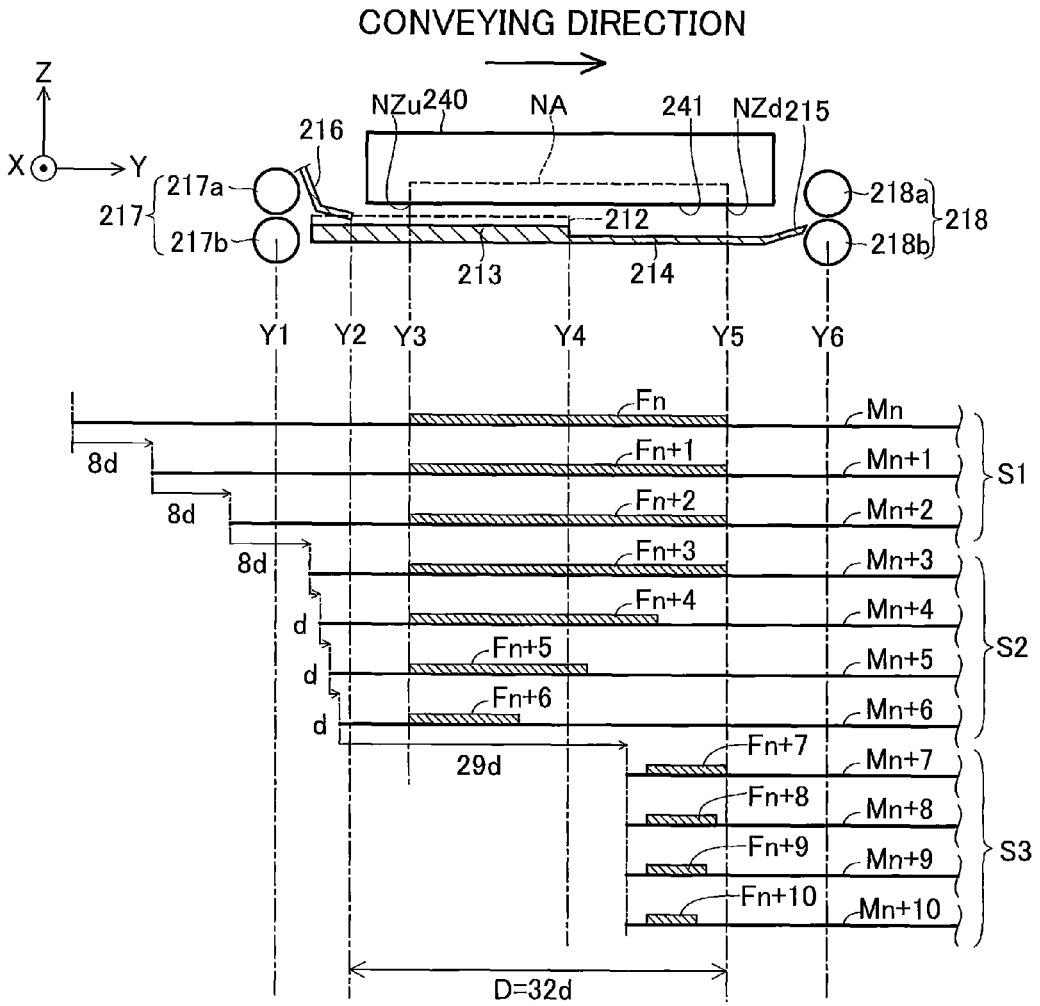
FIG. 7 is an explanatory diagram showing a position of a sheet for each main scan in the second embodiment.

FIG. 6 shows the head position in each main scan in the printing method of a second embodiment for printing an area near the upstream edge of the sheet M in the conveying direction. FIG. 7 shows the position of the sheet M relative to the print head 240 for each main scan when printing an area near the upstream edge of the sheet M according to the method of the second embodiment.

The four-pass print in the second embodiment is implemented according to a shingling technique for distributing the dots formed in a single raster line extending in the main scanning direction among four main scans. Further, in the second embodiment the printer 600 executes a bordered print, in which the printer 600 leaves a margin along all four edges of the sheet M including the upstream edge.

A printing area PA2 is indicated on the right side of FIG. 6 with a dashed line. The printing area PA2 is the area that is printed during the printing process for the sheet M. In the second embodiment, the printing area PA2 is slightly smaller than the size of the sheet M, with the four edges of the printing area PA2 positioned slightly inside (3 mm inside, for example) of the edges corresponding to the sheet M, because the printing process of the second embodiment is a bordered print, as mentioned above.

The printing process according to the second embodiment is identical to that described in the first embodiment up to the $(n+6)^{th}$ main scan (see FIGS. 6 and 7).

After completing the $(n+6)^{th}$ main scan, the CPU 110 executes the $(n+7)^{th}$ sub scan for conveying the sheet M the conveyance amount 29d, and the $(n+7)^{th}$ main scan, as in the first embodiment (see FIGS. 6 and 7).

When the CPU 110 executes the $(n+7)^{th}$ sub scan, as in the first embodiment the upstream edge of the sheet M is moved from the −Y side of position Y2 to a point between positions Y2 and Y6 (see FIG. 7). Consequently, the CPU 110 executes the $(n+7)^{th}$ main scan while the sheet M is in the third state S3.

In the $(n+7)^{th}$ main scan, the CPU 110 executes the printing operation using a set of nozzles NZ that includes the most-downstream nozzle NZd in each nozzle row, while not using a set of nozzles NZ that includes the most-upstream nozzle NZu in each row (see FIGS. 6 and 7). Specifically, the nozzle set used in the $(n+7)^{th}$ main scan covers a range equivalent to 8d from the downstream edge of the nozzle length D.

The CPU 110 further performs the following process (e) according to the second embodiment.

(e) After completing the $(n+7)^{th}$ main scan, the CPU 110 executes the three $(n+8)^{th}$ through $(n+10)^{th}$ main scans without conveying the sheet M, but simply by changing the set of nozzles NZ in the print head 240 that are used for each main scan. Specifically, the number of active nozzles is gradually decreased for each successive main scan in the $(n+8)^{th}$ through $(n+10)^{th}$ main scans. In other word, the print head 240 is driven to execute a printing operation while the sheet is in the third state by using a part of the plurality of nozzles (nozzle set) that is different from a part of the plurality of nozzles (nozzle set) for a previous printing operation. For example, the nozzle set used in the $(n+8)^{th}$ main scan includes nozzles NZ from each nozzle row ranging from a position separated 1d from the downstream edge of the nozzle length D to a position separated 8d from the downstream edge. The nozzle set used in the $(n+9)^{th}$ main scan includes nozzles NZ ranging from a position separated 2d from the downstream edge to a position separated 8d from the downstream edge. The nozzle set used in the $(n+10)^{th}$ main scan includes nozzles NZ ranging from a position separated 3d from the downstream edge to a position separated 8d from the downstream edge. Hence, the upstream edge position of the active nozzle set remains the same in all three $(n+8)^{th}$ through $(n+10)^{th}$ main scans, while the downstream edge position shifts toward the upstream side (the −Y side) for each subsequent main scan (see FIGS. 6 and 7).

As indicated by printing regions Fn+7 through Fn+10 in FIG. 7, the CPU 110 prints in areas that include the upstream edge (−Y edge) of the image printed on the sheet M during the $(n+7)^{th}$ through $(n+10)^{th}$ main scans. Here, the upstream edge of the image printed on the sheet M is on the +Y side of the upstream edge of the sheet M because the printing process according to the second embodiment is a bordered print that leaves a margin on the upstream edge of the sheet M, as described earlier.

After completing the $(n+10)^{th}$ main scan, the CPU 110 drives the downstream drive roller 218*a* to convey the printed sheet M onto a discharge tray (not shown), and subsequently ends the printing process.

According to the second embodiment described above, the CPU 110 performs the processes of (a)-(c) described in the first embodiment. Accordingly, the structure of the second embodiment can suppress unintended deformation in the sheet M while the sheet M is in the third state S3, as described in the first embodiment, thereby suppressing a drop in the quality of the printed image caused by such deformation.

Further, after completing the process of (c) in the second embodiment, the CPU 110 executes a plurality of main scans without conveying the sheet M while changing the set of active nozzles for each main scan. Specifically, the CPU 110 executes the $(n+8)^{th}$ through $(n+10)^{th}$ main scans without conveying the sheet M. As a result, the CPU 110 can execute a printing operation that is suited to the area near the upstream edge of the sheet M and can execute printing that is particularly suited to the area near the upstream edge of the sheet M when employing the shingling technique.

C. Third Embodiment

Figure 8:
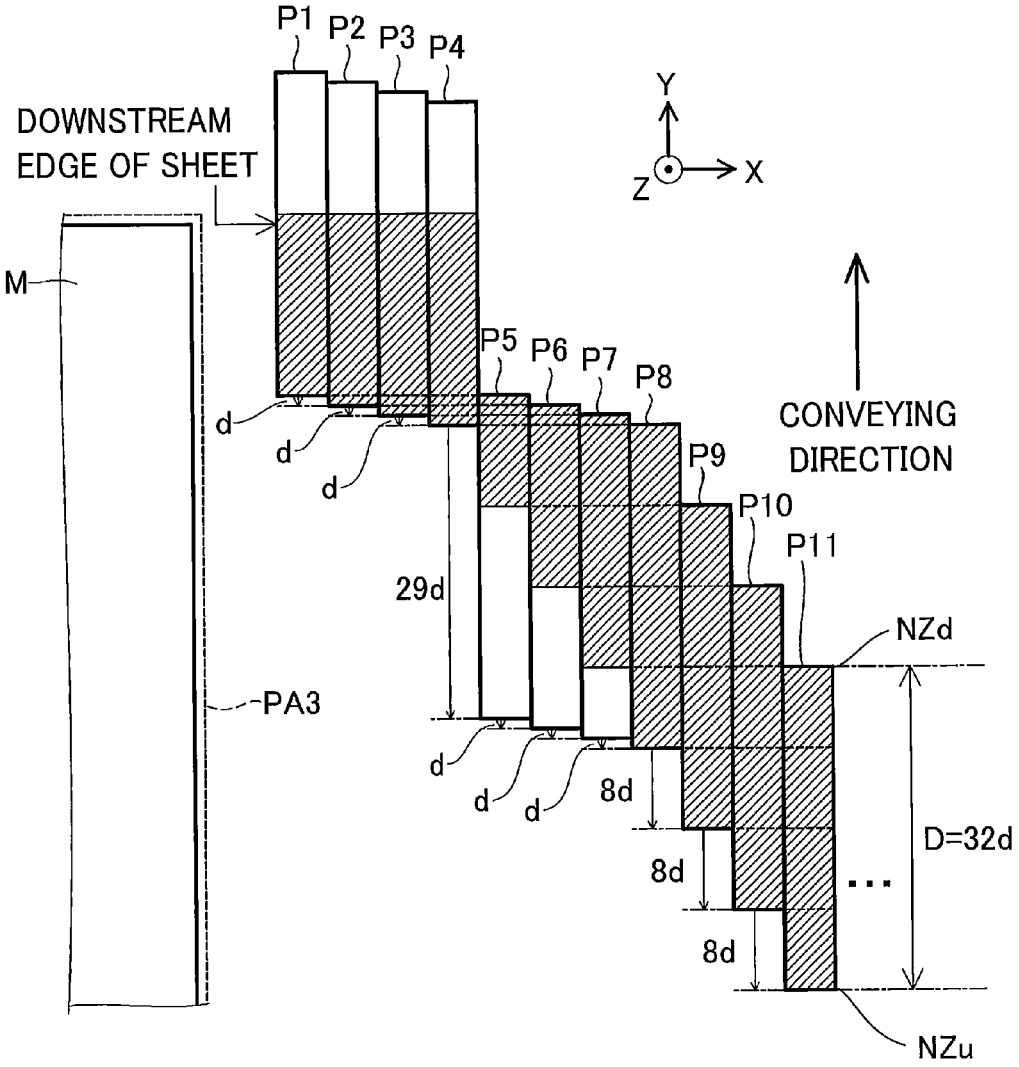
FIG. 8 is an explanatory diagram showing a position of the print head for each main scan in a third embodiment of the present invention.
Figure 9:
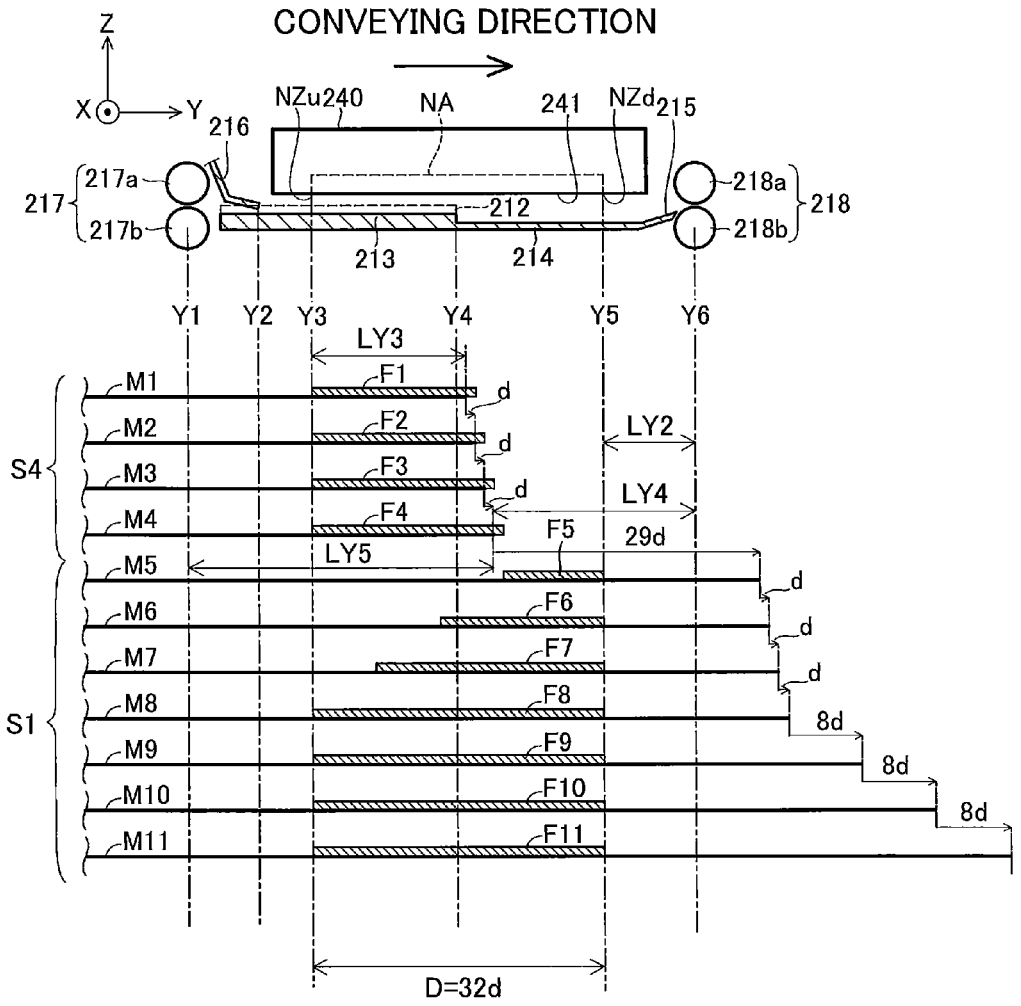
FIG. 9 is an explanatory diagram showing a position of a sheet for each main scan in the third embodiment.

The third embodiment covers a process performed during the printing process executed by the printer 600 to print an area near the downstream edge of the sheet M. FIG. 8 shows the head position in each main scan for printing the area near the downstream edge of the sheet M in the conveying direction. FIG. 9 shows the position of the sheet M relative to the print head 240 for each main scan when printing an area near the downstream edge of the sheet M.

The four-pass print in the third embodiment is a high-resolution print for forming a plurality of raster lines along the main scanning direction at intervals in the conveying direction smaller than the nozzle pitch NT (see FIG. 2; one-fourth of the nozzle pitch NT, for example). Alternatively, a four-pass print may be implemented according to a shingling technique for distributing the dots formed in a single raster line among four main scans. As in the first embodiment, the printer 600 executes a borderless print in the printing process according to the third embodiment. Accordingly, the printing area PA3 in the third embodiment (see FIG. 8) is set slightly larger than the size of the sheet M, as with the printing area PA1 in the first embodiment (see FIG. 4).

FIG. 8 shows eleven head positions P1-P11 corresponding to first through eleventh main scans. FIG. 9 shows eleven paper positions M1-M11 corresponding to the first through eleven main scans. Shaded regions F1-F11 on the sheet M in FIG. 9 denote areas of the sheet M that are printed in the corresponding main scan. The printing regions F1-F11 in FIG. 9 correspond to the positions of the active nozzles depicted by shading in FIG. 8.

The CPU 110 executes a first sub scan for driving the upstream drive roller 217*a* to convey the sheet M to a prescribed initial position, and subsequently executes the first main scan. As shown in FIG. 9, the downstream edge of the sheet M is on the +Y side of position Y4 marking the downstream ends of the support members 212 and 213 when the sheet M is in the initial position M1.

After completing the first main scan, the CPU 110 drives the upstream drive roller 217*a* to perform the three second through fourth sub scans for conveying the sheet M the conveyance amount d and executes a main scan after each sub scan (see FIGS. 8 and 9). Hence, the conveyance amount for the second through fourth sub scans is d. Here, only the upstream drive roller 217*a* is driven because the downstream edge of the sheet M is disposed between positions Y1 and Y6 during the first through fourth sub scans, and thus the sheet M is held only by the upstream rollers 217 and not the downstream rollers 218.

As shown in FIG. 9, the CPU 110 executes the first through fourth main scans while the downstream edge of the sheet M is between the support position Y2 of the high support members 212 and pressing members 216, and the holding position Y6 of the downstream rollers 218. In other words, the CPU 110 executes the first through fourth main scans while the sheet M is held by the upstream rollers 217, is supported by the high support members 212 and pressing members 216, and is not held by the downstream rollers 218. This arrangement is called a fourth state S4 (see FIG. 9).

The CPU 110 executes the printing operations in the first through fourth main scans using a set of the nozzles NZ in each nozzle row of the print head 240 that includes the most-upstream nozzle NZu of the respective row, while not using a set of nozzles NZ that includes the most-downstream nozzle NZd (see FIGS. 8 and 9). The number of active nozzles in the first through fourth main scans increases in succeeding main scans. For example, the nozzle sets used in the first through fourth main scans cover a range from the upstream edge of the nozzle length D equivalent to 18d, 19d, 20d, and 21d, respectively.

As indicated by the printing regions F11-F4 in FIG. 9, the CPU 110 prints in areas that include parts on the +Y side of the downstream edge of the sheet M during the first through fourth main scans. This allows the printer 600 to implement borderless printing that leaves no margin on the downstream edge of the sheet M. Note that the region on the +Y side of the downstream edge of the sheet M in the printing regions F1-F4 is printed on the +Y side of position Y4, where Y4 indicates the downstream ends of the support members 212 and 213. Thus, ink ejected beyond the downstream edge of the sheet M in the +Y direction does not fall on the high support members 212 or low support members 213 that support and contact the sheets M, but falls on the flat plate 214. This configuration restrains ink from becoming deposited on the back surfaces Mb of sheets M in subsequent printing operations.

Through the first through fourth main scans, the CPU 110 completes printing of the partial image near the downstream edge of the sheet M having a width LY3 in the Y direction (17d in the third embodiment; see FIGS. 8 and 9). The width LY3 in the Y direction of the partial image that has been printed up to this point is greater than a distance LY2 in the Y direction from the position Y5 marking the most-downstream nozzle NZd to the holding position Y6 of the downstream rollers 218 (see FIG. 9; LY3>LY2).

After completing the fourth main scan, the CPU 110 executes the fifth sub scan for driving the upstream drive roller 217*a* to convey the sheet M a conveyance amount 29d, followed by the fifth main scan (see FIGS. 8 and 9). Hence, the conveyance amount for the fifth sub scan is the 29d, which is twenty-nine times larger than the conveyance amount d used in the second through fourth sub scans. This conveyance amount 29d is greater than the distance LY2 in the Y direction (see FIG. 9) from position Y5 of the most-downstream nozzle NZd to the holding position Y6 of the downstream rollers 218. The conveyance amount 29d is also greater than a distance LY4 in the Y direction from the downstream edge of the sheet M during the fourth main scan (i.e., the downstream edge of the sheet M at paper position M4 in FIG. 9) to the holding position Y6 of the downstream rollers 218.

When the CPU 110 executes the fifth sub scan, the downstream edge of the sheet M is moved from the −Y side of the holding position Y6 to the +Y side of the holding position Y6, as shown in FIG. 9. Consequently, the CPU 110 executes the fifth main scan while the sheet M is in the first state S1 described in the first embodiment, held by both the upstream rollers 217 and downstream rollers 218 (see FIGS. 8 and 9). By using the conveyance amount 29d for the fifth sub scan, which is greater than the distance LY2 and greater than the distance LY4, as described above, the CPU 110 can suitably convey the sheet M to a position at which the fifth sub scan can be executed while the sheet M is in the first state S1.

Once the sheet M is in the first state S1, a region on the sheet M that is at least equivalent to the distance LY2 from the downstream edge of the sheet M is positioned on the +Y side of the position Y5 indicating the most-downstream nozzle NZd. Therefore, the CPU 110 can no longer print in this region on the downstream edge of the sheet M equivalent in width to the distance LY2 after the sheet M reaches the first state S1. However, the partial image that has been printed once the final main scan has been executed while the sheet M is in the fourth state S4 (the fourth main scan in the third embodiment) has a width LY3 in the Y direction that is greater than the distance LY2 (see FIG. 9; LY3>LY2). Accordingly, the CPU 110 can suitably print up to the downstream edge of the sheet M.

In the fifth main scan, the CPU 110 executes the printing operation using a set of nozzles NZ in each nozzle row that includes the most-downstream nozzle NZd of that row, while not using a set of nozzles NZ that includes the most-upstream nozzle NZu in each row (see FIGS. 8 and 9). Specifically, the nozzle set used in the fifth main scan covers a range equivalent to 11d from the downstream edge of the nozzle length D.

As shown in FIGS. 8 and 9, a third nozzle set used in the fourth main scan is not used in the fifth main scan, and a fourth nozzle set used in the fifth main scan is not used in the fourth main scan.

After completing the fifth main scan, the CPU 110 alternately executes each of three sixth through eighth sub scans for driving the upstream drive roller 217*a* and downstream drive roller 218*a* to convey the sheet M the conveyance amount d with each of three sixth through eighth main scans (see FIGS. 8 and 9). The conveyance amount used in the sixth through eight sub scans is the conveyance amount d, which is one twenty-ninth of the conveyance amount 29d used in the fifth sub scan.

As in the fifth main scan, the CPU 110 executes the sixth through eighth main scans while the sheet M is in the first state S1 held by both the upstream rollers 217 and downstream rollers 218 (see FIGS. 8 and 9).

In the sixth and seventh main scans, the CPU 110 executes the printing operation using a set of nozzles NZ in each nozzle row that includes the most-downstream nozzle NZd of that row, while not using a set of nozzles NZ that includes the most-upstream nozzle NZu in each row (see FIGS. 8 and 9). For example, the nozzle sets used in the sixth and seventh main scans cover a range from the downstream edge of the conveyance amount d equivalent to 18d and 25d, respectively. In the eighth main scan, the CPU 110 executes the printing operation using all nozzles formed in the print head 240.

After completing the eighth main scan, the CPU 110 executes a printing operation for the center region of the sheet M relative to the conveying direction by repeatedly and alternately executing a prescribed number of sub scans beginning from the ninth sub scan, and a prescribed number of main scans beginning from the ninth main scan. The CPU 110 executes the sub scans by driving the upstream drive roller 217*a* and downstream drive roller 218*a* to convey the sheet M the conveyance amount 8d. FIG. 9 shows three head positions P9-P11 and three corresponding paper positions M9-M11 corresponding to three of these main scans, and specifically the ninth through eleventh main scans. Here, the conveyance amount 8d is one-fourth the nozzle length D and is a uniform conveyance amount HM for a four-pass print.

When the CPU 110 executes the printing operation for the ninth through eleventh main scans, all nozzles NZ formed in the print head 240 are active nozzles (see FIGS. 8 and 9).

In the third embodiment, the support position Y2 of the high support members 212 and pressing members 216 lies between the print head 240 and the upstream rollers 217. Therefore, the CPU 110 executes all first through ninth pass processes while the sheet M is supported by the high support members 212 and pressing members 216. Accordingly, the sheet M is supported by the high support members 212 and pressing members 216 whether the sheet M is in the fourth state S4 or the first state S1.

After printing the center region of the sheet M in the conveying direction, the CPU 110 executes the printing operation in the area near the upstream edge of the sheet M to complete the printing process. Once the printing process is completed, the CPU 110 drives the downstream drive roller 218*a* to convey the sheet M onto a discharge tray (not shown), and subsequently ends the printing process.

The CPU 110 performs the following processes according to the third embodiment described above.

(f) The CPU 110 executes a plurality of times each an operation to drive the upstream drive roller 217*a* in order to convey the sheet M a fifth conveyance amount (d in the third embodiment), and a main scan operation while the sheet M is in the fourth state S4. More specifically, the CPU 110 executes three sub scans at the conveyance amount d before each of three respective second through fourth main scans. The fifth conveyance amount is an example of a first conveyance distance.

(g) After completing the process of (f), the CPU 110 executes at least one time each an operation to drive the upstream drive roller 217*a* in order to convey the sheet M a sixth conveyance amount (29d in the third embodiment) greater than the fifth conveyance amount, and a main scan operation while the sheet M is in the first state S1. More specifically, the CPU 110 executes the fifth sub scan at the conveyance amount 29d and the fifth main scan. Here, the sixth conveyance amount is greater than the distance LY2 in the Y direction (see FIG. 9) from the position Y5 of the most-downstream nozzle NZd to the holding position Y6 of the downstream rollers 218. The sixth conveyance amount is an example of a second conveyance distance.

(h) After completing the process of (g), the CPU 110 executes a plurality of times an operation to drive the upstream drive roller 217*a* and downstream drive roller 218*a* in order to convey the sheet M a seventh conveyance amount (d in the third embodiment) smaller than the sixth conveyance amount, and a main scan operation while the sheet M is in the first state S1. More specifically, the CPU 110 executes each of three sub scans at the conveyance amount d prior to executing each of three main scans. The seventh conveyance amount is an example of a third conveyance distance.

In the fourth state S4, the sheet M is held by the upstream rollers 217 but not by the downstream rollers 218, and the downstream edge of the sheet M is disposed between the holding position Y1 of the upstream rollers 217 and the holding position Y6 of the downstream rollers 218. This arrangement does not suppress deformation of the sheet M, inviting movement in the downstream edge of the sheet M. The downstream edge of the sheet M is more likely to move the greater the distance LY5 (see FIG. 9) from the holding position Y1 at which the upstream rollers 217 hold the sheet M to the downstream edge of the sheet M. According to the configuration described above, the sheet M is subsequently conveyed the relatively large sixth conveyance amount (specifically, 29d) and shifts from the fourth state S4 to the first state S1, at which time the sheet M is held by both the upstream rollers 217 and downstream rollers 218. Accordingly, the distance LY5 can be set relatively short when the sheet M is in the fourth state S4. For example, the configuration of the embodiment can reduce the distance LY5 from the upstream rollers 217 to the downstream edge of the sheet M when the sheet M is in the fourth state S4 more than when four-pass printing is executed using a uniform conveyance amount HM (8d, for example) for all sub scans. Hence, the printer 600 can minimize degradation in printing quality when printing on a sheet M in the fourth state S4. Further, by shortening the position Y5, the configuration of the embodiment can reduce the area near the downstream edge of the sheet M that is printed while the sheet M is in the fourth state S4, thereby minimizing degradation in print quality.

The printing process according to the third embodiment is particularly advantageous when the nozzle length D of the print head 240 is larger since the distance LY5 from the upstream rollers 217 to the downstream edge of the sheet M when the sheet M is in the fourth state S4 tends to increase for longer nozzle length D. Further, printing time while the sheet M is in the fourth state S4 is longer particularly longer in multi-pass printing, since the number of main scans executed while the sheet M is in a single-held state is greater than when performing single-pass printing. Thus, the printing process of the third embodiment is advantageous because the sheet M is more likely to deform in the single-held state when the printing time in the single-held state is longer.

Further, the CPU 110 begins the process of (g) after completing printing of an image on the sheet M in the process of (f) that has a width in the conveying direction (+Y direction) greater than the distance LY2 from the position Y5 of the most-downstream nozzle NZd to the holding position Y6 of the downstream rollers 218. Specifically, after printing a partial image having a width LY3 greater than the distance LY2 in the Y direction (see FIG. 9) through the fourth main scan as described above, the CPU 110 conveys the sheet M the sixth conveyance amount 29d. Thus, the printer 600 can reliably print on the downstream edge of the sheet M relative to the conveying direction while suppressing deformation in the sheet M when the sheet M is in the unstable fourth state S4 described above. If the CPU 110 were to convey a sheet M by a conveyance amount greater than the distance LY2 to shift the sheet M from the fourth state S4 to the first state S1 prior to completing printing of a partial image having a width greater than the distance LY2, the CPU 110 may not be able to print the area near the downstream edge of the sheet M when executing a borderless print leaving no margin on the downstream edge of the sheet M or when printing with a relatively small margin on the downstream edge of the sheet M.

In the fourth main scan, which is the final main scan in the process of (f), the CPU 110 uses the most-upstream nozzle NZu in each nozzle row, but not the most-downstream nozzle NZd. Conversely, in the fifth main scan, which is the initial main scan in the process of (g), the CPU 110 uses the most-downstream nozzle NZd, but not the most-upstream nozzle NZu. Thus, the CPU 110 can execute suitable printing for the main scans performed before and after the fifth sub scan for conveying the sheet M the relatively large sixth conveyance amount (specifically, 29d).

Further, in the fourth main scan, which is the final main scan in the process of (f), the CPU 110 uses a third nozzle set, but not a fourth nozzle set positioned downstream of the third nozzle set in the conveying direction. Conversely, in the fifth main scan, which is the initial main scan in the process of (g), the CPU 110 uses the fourth nozzle set, but not the third nozzle set. Thus, by executing printing operations using different nozzle sets in the main scans before and after the fifth sub scan for conveying the sheet M the sixth conveyance amount, the CPU 110 can convey the sheet M the relatively large sixth conveyance amount in the fifth sub scan.

Further, the pluralities of high support members 212 and pressing members 216 support the sheet M when the sheet M is in the fourth state S4. Thus, the sheet M is transformed into a corrugated state that undulates along the X direction, even when the sheet M is in the fourth state S4. Accordingly, the configuration of the third embodiment better suppresses unintended deformation in the sheet M, such as warping in the Y direction when the sheet M is in the fourth state S4, thereby more effectively suppressing deterioration in the quality of the printed image.

D. Fourth Embodiment

Figure 10:
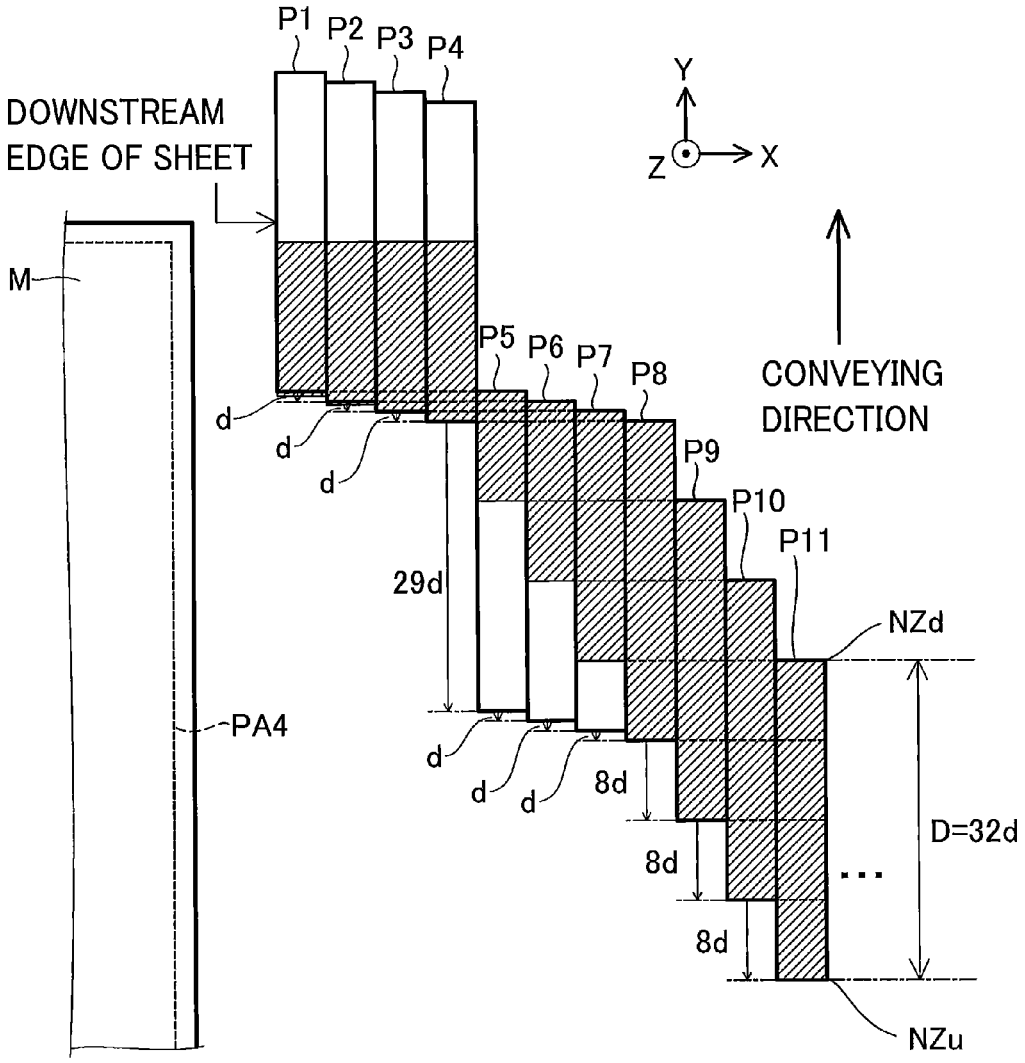
FIG. 10 is an explanatory diagram showing a position of the print head for each main scan in a fourth embodiment of the present invention.
Figure 11:
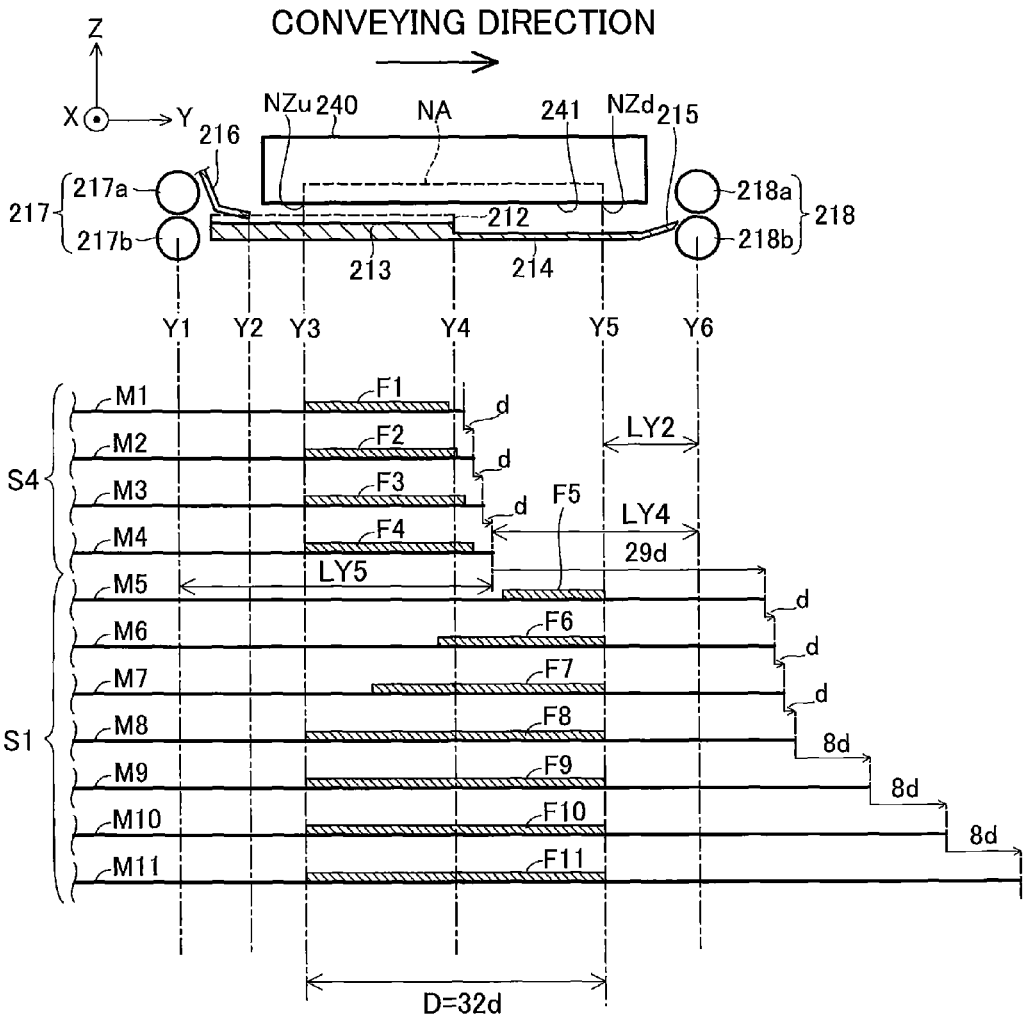
FIG. 11 is an explanatory diagram showing a position of a sheet for each main scan in the fourth embodiment.

FIG. 10 shows the head position in each main scan in the printing method of a fourth embodiment for printing an area near the downstream edge of the sheet M in the conveying direction. FIG. 11 shows the position of the sheet M relative to the print head 240 for each main scan when printing an area near the downstream edge of the sheet M according to the method of the fourth embodiment.

As in the first and third embodiments described above, the four-pass print in the fourth embodiment is a high-resolution print for forming raster lines along the main scanning direction at intervals in the conveying direction smaller than the nozzle pitch NT (see FIG. 2). Alternatively, a four-pass print may be implemented according to a shingling technique for distributing the dots formed in a single raster line among four main scans. As in the second embodiment, the printer 600 executes a bordered print in the fourth embodiment. Hence, a printing area PA4 (see FIG. 10) in the fourth embodiment is slightly smaller than the size of the sheet M, as is the printing area PA2 in the second embodiment (see FIG. 6).

As in the third embodiment, the CPU 110 executes the first main scan after first driving the upstream drive roller 217*a* to convey the sheet M up to its prescribed initial position. After performing the first main scan, the CPU 110 executes three each of a sub scan for driving at least the upstream drive roller 217*a* to convey the sheet the conveyance amount d, and a main scan executed after the sub scan, as described in the third embodiment (see FIGS. 10 and 11). Hence, the conveyance amount d is used in the three second through fourth sub scans.

In the first through fourth main scans, the CPU 110 executes printing operations using a set of nozzles NZ that includes the most-upstream nozzle NZu of each row, while not using a set of nozzles NZ that includes the most-downstream nozzle NZd of each row (see FIGS. 10 and 11). In the fourth embodiment, the lengths of nozzle sets used in the first through fourth main scans in the Y-direction are shorter than the lengths used in the third embodiment by 3d. That is, the CPU 110 executes the first through fourth main scans using nozzle sets having a range from the upstream edge of the nozzle length D equivalent to 15d, 16d, 17d, and 18d, respectively.

As indicated by printing regions F1-F4 in FIG. 11, the CPU 110 prints in areas that include the downstream edge (+Y edge) of the image printed on the sheet M during the first through fourth main scans. Here, the downstream edge of the image printed on the sheet M is on the −Y side of the downstream edge of the sheet M, because the printing process according to the fourth embodiment is a bordered print, as described earlier.

After completing the fourth main scan, the CPU 110 drives at least one of the upstream drive roller 217*a* and downstream drive roller 218*a* to convey the sheet M the conveyance amount 29d, and subsequently executes the fifth main scan, as in the third embodiment (see FIGS. 10 and 11). Thereafter, the CPU 110 repeatedly executes each of a plurality of sub scans from the sixth sub scan until the completion of printing, and each of a plurality of main scans from the sixth main scan until the completion of printing.

According to the fourth embodiment described above, the CPU 110 performs the processes of (f)-(h) described in the third embodiment. Accordingly, the structure of the fourth embodiment can suppress unintended deformation in the sheet M while the sheet M is in the fourth state S4, as described in the third embodiment. Thus, the structure according to the fourth embodiment can reduce the area susceptible to a drop in image quality caused by deformation of the sheet M, thereby suppressing a drop in the quality of the printed image. Further, the printer 600 according to the fourth embodiment can suitably perform bordered printing.

E. Variations of the Embodiments (1) In the printing process of the first and second embodiments described above, the printer 600 executes printing according to a four-pass print, whereby a pass number PS is 4. However, the printer 600 may execute printing processes using a printing method with a different pass number PS from 4, such as 2, 3, or 8. Here, the pass number PS indicates the number of main scans required for printing one region of the sheet M, such as a partial area with a dimension in the conveying direction equivalent to the nozzle length D.

No matter what value the pass number PS is, the CPU 110 preferably performs the process in (a) for executing an operation to drive at least one of the drive rollers 217*a* and 218*a* to convey the sheet M the first conveyance amount (8d in the first embodiment described above), and the main scan operation while the sheet M is in the first state S1 at least one time each; the process of (b) for executing, after the process of (a), an operation to drive at least the downstream drive roller 218*a* to convey the sheet M the second conveyance amount no greater than the first conveyance amount (8d and d in the first embodiment described above), and the main scan operation while the sheet M is in the second state S2 at least one time each; and the process of (c) for executing, after the process of (b), an operation to drive at least the downstream drive roller 218*a* to convey the sheet M the third conveyance amount greater than the first conveyance amount (29d in the first embodiment described above), and a main scan operation while the sheet M is in the third state S3.

In the first embodiment described above, a sub scan is performed three times at a second conveyance amount H2 (conveyance amount d in the embodiments) that is smaller than the third and first conveyance amounts prior to performing a sub scan at the third conveyance amount, but in general the number of sub scans performed at this small conveyance amount H2 should be at least (PS−1). This allows the third conveyance amount to be set to a sufficiently large distance. However, since the printing speed may drop when the number of sub scans performed at the small conveyance amount H2 is greater than or equal to the pass number PS, it is preferable to set the number of sub scans performed at the small second conveyance amount H2 to (PS−1).

A maximum value H3 of the third conveyance amount can be expressed according to Equation (1) below using the pass number PS, the conveyance amount H2, and the nozzle length D.

$$H3=D-\{(PS-1)\times H2\} \quad (1)$$

The nozzle length D may be calculated by multiplying the pass number PS by the uniform conveyance amount HM when printing for the pass number PS is executed using uniform conveyance amounts (D=PS×HM).

In the first embodiment described above, the pass number PS is 4, the nozzle length D is 32d, the uniform conveyance amount HM is 8d, and the second conveyance amount H2 is d. Therefore, H3=32d−3d=29d. From this equation, it is clear that the third conveyance amount can be set to a larger value when the second conveyance amount H2 is smaller. Hence, by setting the second conveyance amount H2 to the smallest possible value at which conveyance precision can be ensured, the third conveyance amount can be set larger. As a result, the length from the holding position Y6 of the downstream rollers 218 to the upstream edge of the sheet M can be further reduced for the time that the sheet M is in the third state S3. Thus, this method of conveyance can further suppress deformation in the sheet M, thereby suppressing a drop in quality of the printed image.

For example, when PS=4 (four-pass printing) as in the first embodiment, the third conveyance amount (29d in the first embodiment) is preferably set at least 2 times the first conveyance amount (8d in the first embodiment), and more preferably set at least 3 times the first conveyance amount. If PS=3 (three-pass printing) the third conveyance amount is preferably set at least 1.5 times the first conveyance amount, and more preferably at least 2 times the first conveyance amount. If PS=2 (two-pass printing), the third conveyance amount is preferably set at least 1.3 times the first conveyance amount, and more preferably at least 1.7 times the first conveyance amount.

Further, the third conveyance amount (29d in the first embodiment) is preferably set to at least 50% the nozzle length D (32d in the embodiments), and more preferably at least 70% the nozzle length D, irrespective of the value of the pass number PS.

(2) In the third and fourth embodiments described above, the printing process is executed using four-pass printing in which the pass number PS is 4. However, the printing process may be executed according to a different method having a pass number PS other than 4, such as 2, 3, or 8.

Regardless of the pass number PS, the CPU 110 preferably (f) executes a plurality of times each of an operation to drive at least the upstream drive roller 217*a* to convey the sheet M the fifth conveyance amount (d in the third embodiment), and a main scan operation while the sheet M is in a single-held state; (g) executes at least one time following the process of (f) each of an operation to drive at least the upstream drive roller 217*a* to convey the sheet M the sixth conveyance amount (29d in the third embodiment) greater than the fifth conveyance amount, and a main scan operation while the sheet M is in a double-held state; and (h) executes a plurality of times following the process of (g) each of an operation to drive at least one of the drive rollers 217*a* and 218*a* to convey the sheet M the seventh conveyance amount (d in the third embodiment) smaller than the sixth conveyance amount, and a main scan operation while the sheet M is in a double-held state. The sixth conveyance amount is preferably larger than the distance LY2 in the Y direction (see FIG. 9) from the position Y5 of the most-downstream nozzle NZd to the holding position Y6 of the downstream rollers 218.

In the first embodiment, three sub scans are performed at the fifth conveyance amount H5 (d in the third embodiment), but in general it is preferable that the number of sub scans at the fifth conveyance amount H5 is set to (PS−1) or greater. In this way, the sixth conveyance amount can be set to a sufficiently large value. However, when sub scans at the fifth conveyance amount H5 are performed a number of times equal to or greater than the pass number PS, printing speed can worsen. Therefore, the number of sub scans performed at this small fifth conveyance amount H5 is preferably set to a value equivalent to (PS−1).

A maximum value H6 for the sixth conveyance amount can be expressed with Equation (2) below using the pass number PS, the fifth conveyance amount H5, and the nozzle length D.

$$H6=D-\{(PS-1)\times H5\} \quad (2)$$

The nozzle length D is calculated by multiplying the pass number PS by the uniform conveyance amount HM used when executing a print with the pass number PS at a uniform conveyance amount (D=PS×HM).

In the third embodiment described above, the pass number PS is 4, the nozzle length D is 32d, the uniform conveyance amount HM is 8d, and the fifth conveyance amount H5 is d. Hence, H6=32d−3d=29d. As is clear from this equation, the sixth conveyance amount can be set larger by reducing the fifth conveyance amount H5. Therefore, by setting the fifth conveyance amount H5 as small as possible while still ensuring conveyance precision, the sixth conveyance amount can be set larger. Thus, the maximum value H6 of the sixth conveyance amount can be increased the more the fifth conveyance amount H5 is decreased. In this way, the distance LY5 (see FIG. 9) from the holding position Y1 of the upstream rollers 217 to the downstream edge of the sheet M can be decreased while the sheet M is in a single-held state. This arrangement can further suppress deformation in the sheet M, thereby further suppressing a decline in the quality of the printed image.

When PS=4 (four-pass printing) as in the third embodiment, the sixth conveyance amount (29d in the third embodiment) is preferably set to at least 2 times the uniform conveyance amount HM (8d in the third embodiment), and more preferably at least 3 times the uniform conveyance amount HM. When PS=3 (three-pass printing), the sixth conveyance amount is preferably set to at least 1.5 times the uniform conveyance amount HM, and more preferably at least 2 times the uniform conveyance amount HM. When PS=2 (two-pass printing), the sixth conveyance amount is preferably set to at least 1.3 times the uniform conveyance amount HM, and more preferably at least 1.7 times the uniform conveyance amount HM.

Further, the sixth conveyance amount (29d in the embodiments) is preferably set to at least 60% the nozzle length D (32d in the embodiments), and more preferably set to at least 80% the nozzle length D.

(3) By executing the computer program 132 (see FIG. 1) in the first to fourth embodiments described above, the CPU 110 in the printer 600 implements a printing process in which the sub scans and main scans shown in FIGS. 4 through 11 are executed repeatedly. However, the CPU of an external device such as a personal computer connected to a printer may be configured to execute a printer driver program installed on the external device in order to control the printer to implement the printing processes of the embodiments.

In this case, the CPU generates dot data from target image data representing an image to be printed (image data compressed in the JPEG format or image data described in a page description language, for example) by executing the rasterization process, color conversion process, and halftone process on the target image data, as described in the first embodiment, for example. Using this dot data, the CPU of the external device further generates a print job that includes print data obtained by rearranging the order in which dot data is used in the plurality of main scans, and control data for controlling the printer. The control data includes data specifying active nozzles to be used in each of the main scans, and data specifying a conveyance amount for each of the sub scans. The CPU of the external device supplies the generated print job to the printer, and the printer executes a printing process according to the print job.

As should be clear from the above description, the printing mechanism 200 (see FIG. 1) in the embodiments is an example of the print-executing unit, while the printer to which the print job is supplied in this variation is an example of the print-executing unit.

(4) The number of main scans performed on the sheet M in the first state S1 and the number performed on the sheet M in the second state S2 may be modified depending on the interval between the holding position Y1 of the upstream rollers 217 and the support position Y2 of the high support members 212 and pressing members 216, the magnitude of the relatively small conveyance amount (d in the embodiments) executed prior to conveying the sheet M the third conveyance amount, and the like. For example, the interval between positions Y1 and Y2 may vary according to the size and shape of the upstream rollers 217 and pressing members 216.

In the example of the first embodiment, the main scans up to the $(n+2)^{th}$ main scan are executed while the sheet M is in the first state S1, and the next four $(n+3)^{th}$ through $(n+6)^{th}$ main scans are executed while the sheet M is in the second state S2. Accordingly, the first conveyance amount used for the sub scan performed prior to a main scan executed while the sheet M is in the first state S1 is 8d, and the second conveyance amount used in the sub scan performed before a main scan executed while the sheet M is in the second state S2 includes 8d and d.

For example, if position Y1 were moved in the +Y direction from the position shown in FIG. 5 so that the distance between positions Y1 and Y2 were shorter than the example of FIG. 5, the CPU 110 could execute printing operations up through the $(n+3)^{th}$ main scan while the sheet M is in the first state S1, and could execute printing operations in the three $(n+4)^{th}$ through $(n+6)^{th}$ main scans while the sheets M is in the second state S2. In this case, the first conveyance amount for sub scans performed prior to main scans executed while the sheet M is in the first state S1 would be 8d, while the second conveyance amount for sub scans performed prior to main scans executed while the sheet M is in the second state S2 would be only d.

In either case, the second conveyance amount is preferably less than or equal to the first conveyance amount, and the third conveyance amount is preferably greater than the first conveyance amount. Further, the CPU 110 preferably executes at least one main scan while the sheet M is in the first state S1 and at least one main scan while the sheet M is in the second state S2. The same holds true for the second embodiment.

(5) The printer 600 may also execute a printing process that combines the printing process according to the first embodiment and the printing process according to the third embodiment. For example, the CPU 110 may print the area near the downstream edge of the sheet M using the printing process of the third embodiment, and may print the area near the upstream edge of the sheet M using the printing process of the first embodiment. Similarly, the printer 600 may execute a printing process that combines the printing process according to the second embodiment and the printing process according to the fourth embodiment.

(6) In the third and fourth embodiments described above, the sheet support 211 of the conveying mechanism 210 (see FIG. 3) may be configured of a simple flat plate. In other words, the sheet support 211 need not be provided with the high support members 212 and low support members 213. Further, the pressing members 216 may be omitted from the conveying mechanism 210. Hence, in the third and fourth embodiments described above, the sheet M need not be supported by the high support members 212, low support members 213, and pressing members 216 when conveyed by the conveying mechanism 210.

(7) In place of the support members that support the sheet M while transforming the sheet M into a corrugated state undulating in the X direction in the embodiments described above, the conveying mechanism 210 may be provided with support members that support the sheet M in a flat state without deforming the sheet M into a corrugated state. For example, the sheet support 211 in FIG. 3 may be provided solely with the plurality of low support members 213 and pressing members 216 and not the plurality of high support members 212.

(8) In the embodiments described above, the center region of the sheet M is printed using four-pass printing with a uniform conveyance amount 8d, but this center region may be printed using four-pass printing with varied conveyance amounts. In this case, the first conveyance amount according to the first and second embodiments, and specifically the conveyance amount used in the $n^{th}$ through $(n+2)^{th}$ sub scans may include some or all of the varied conveyance amounts. Similarly, the conveyance amount used in the eighth through eleventh sub scans in the third and fourth embodiments may include some or all of the varied conveyance amounts.

(9) In the first embodiment described above, the CPU 110 drives both the drive rollers 217*a* and 218*a* in the $n^{th}$ through $(n+2)^{th}$ sub scans, but the CPU 110 should drive at least one of these drive rollers 217*a* and 218*a*. Further, while the CPU 110 drives only the downstream drive roller 218*a* in sub scans beginning from the $(n+3)^{th}$ sub scan, the CPU 110 should drive at least the downstream drive roller 218*a*. In the third embodiment described above, the CPU 110 drives only the upstream drive roller 217*a* in the first through fifth sub scans, but the CPU 110 should drive at least the upstream drive roller 217*a*. Similarly, the CPU 110 drives both the drive rollers 217*a* and 218*a* in the sixth and subsequent sub scans, but the CPU 110 should drive at least one of the drive rollers 217*a* and 218*a*.

(10) Part of the configuration implemented in hardware in the embodiments may be replaced with software and, conversely, all or part of the configuration implemented in software in the embodiments may be replaced with hardware.

While the invention has been described in detail with reference to specific embodiments and variations thereof, it would be apparent to those skilled in the art that many modifications and variations may be made therein without departing from the spirit of the invention, the scope of which is defined by the attached claims.

What is claimed is:

1. A printing device comprising:

a print head having a plurality of nozzles arranged in a conveying direction, the plurality of nozzles including a most-downstream nozzle that is disposed at a most downstream position in the conveying direction among the plurality of nozzles;

a conveying mechanism configured to convey a sheet in the conveying direction, the sheet having one surface and another surface opposite to the one surface, the conveying mechanism including:

a first roller disposed upstream of the print head in the conveying direction; and a second roller disposed downstream of the print head in the conveying direction; and a control device;

wherein the control device is configured to control the print head and the conveying mechanism to:

execute a first process a plurality of times, the first process being a process in which:

at least the first roller is driven to convey the sheet a first conveyance distance; and the print head is driven to execute a printing operation while the sheet is in a state where the sheet is supported by the first roller and where the sheet is not supported by the second roller;

execute a second process at least one time after the first process is executed the plurality of times, the second process being a process in which:

at least the first roller is driven to convey the sheet a second conveyance distance that is larger than the first conveyance distance; and the print head is driven to execute a printing operation while the sheet is in a state where the sheet is supported by the first roller and the second roller; and execute a third process a plurality of times after the second process is executed, the third process being a process in which:

at least one of the first roller and the second roller is driven to convey the sheet a third conveyance distance that is less than the second conveyance distance; and the print head is driven to execute a printing operation while the sheet is in a state where the sheet is supported by the first roller and the second roller, wherein the second conveyance distance is larger than a distance between the most-downstream nozzle and the second roller in the conveying direction.

2. The printing device according to claim 1, wherein the control device is configured to begin the second process after an image having a prescribed width in the conveying direction is printed on the sheet in the first process, the prescribed width being larger than the distance between the most-downstream nozzle and the second roller in the conveying direction.

3. The printing device according to claim 1, wherein the plurality of nozzles further includes a most-upstream nozzle that is disposed at a most upstream position in the conveying direction among the plurality of nozzles;

wherein the control device is configured to control the print head to execute a printing operation using the most-upstream nozzle and not using the most-downstream nozzle when the first process is executed at a last time;

wherein the control device is configured to control the print head to execute a printing operation using the most-downstream nozzle and not using the most-upstream nozzle when the second process is executed.

4. The printing device according to claim 1, wherein the plurality of nozzles includes a first set of nozzles and a second set of nozzles that are positioned downstream of the first set of nozzles in the conveying direction;

wherein the control device is configured to control the print head to execute a printing operation using the first set of nozzles and not using the second set of nozzles when the first process is executed at a last time;

wherein the control device is configured to control the print head to execute a printing operation using the second set of nozzles and not using the first set of nozzles when the second process is executed.

5. A non-transitory computer readable storage medium storing a set of program instructions executed by a computer, the computer being configured to control a printing execution unit including a print head and a conveying mechanism, the print head having a plurality of nozzles arranged in a conveying direction, the plurality of nozzles including a most-downstream nozzle that is disposed at a most downstream position in the conveying direction among the plurality of nozzles, the conveying mechanism being configured to convey a sheet in the conveying direction, the sheet having one surface and another surface opposite to the one surface, the conveying mechanism including a first roller and a second roller, the first roller being disposed upstream of the print head in the conveying direction, the second roller being disposed downstream of the print head in the conveying direction, the program instructions, when executed by the computer, causing the printing execution unit to:

execute a first process a plurality of times, the first process being a process in which:

at least the first roller is driven to convey the sheet a first conveyance distance; and the print head is driven to execute a printing operation while the sheet is in a state where the sheet is supported by the first roller and where the sheet is not supported by the second roller;

execute a second process at least one time after the first process is executed the plurality of times, the second process being a process in which:

at least the first roller is driven to convey the sheet a second conveyance distance that is larger than the first conveyance distance; and the print head is driven to execute a printing operation while the sheet is in a state where the sheet is supported by the first roller and the second roller; and execute a third process a plurality of times after the second process is executed, the third process being a process in which:

at least one of the first roller and the second roller is driven to convey the sheet a third conveyance distance that is less than the second conveyance distance; and the print head is driven to execute a printing operation while the sheet is in a state where the sheet is supported by the first roller and the second roller, wherein the second conveyance distance is larger than a distance between the most-downstream nozzle and the second roller in the conveying direction.

* * * * *